US011408365B2

(12) United States Patent
Dölker

(10) Patent No.: US 11,408,365 B2
(45) Date of Patent: Aug. 9, 2022

(54) METHOD FOR OPERATING AN INJECTION SYSTEM OF AN INTERNAL COMBUSTION ENGINE, AN INJECTION SYSTEM FOR AN INTERNAL COMBUSTION ENGINE, AND AN INTERNAL COMBUSTION ENGINE INCLUDING AN INJECTION SYSTEM

(71) Applicant: Rolls-Royce Solutions GmbH, Friedrichshafen (DE)

(72) Inventor: Armin Dölker, Friedrichshafen (DE)

(73) Assignee: Rolls-Royce Solutions GmbH, Friedrichshafen (DE)

( * ) Notice: Subject to any disclaimer, the term of this patent is extended or adjusted under 35 U.S.C. 154(b) by 0 days.

(21) Appl. No.: 17/401,984

(22) Filed: Aug. 13, 2021

(65) Prior Publication Data

US 2021/0372343 A1 Dec. 2, 2021

Related U.S. Application Data

(63) Continuation of application No. PCT/EP2020/053741, filed on Feb. 13, 2020.

(30) Foreign Application Priority Data

Feb. 14, 2019 (DE) ..... 10 2019 202 004.6

(51) Int. Cl.
*F02D 41/38* (2006.01)
*F02M 55/02* (2006.01)
(Continued)

(52) U.S. Cl.
CPC ..... *F02D 41/3863* (2013.01); *F02D 41/22* (2013.01); *F02M 55/025* (2013.01); *F02M 63/023* (2013.01); *F02D 2041/225* (2013.01)

(58) Field of Classification Search
CPC .. F02D 41/3863; F02D 41/22; F02D 41/3845; F02D 2041/225;
(Continued)

(56) References Cited

U.S. PATENT DOCUMENTS 6,119,655 A * 9/2000 Heinitz ..... F02D 41/3863 123/458
2006/0288984 A1 12/2006 Achleitner et al.
(Continued)

FOREIGN PATENT DOCUMENTS

DE 10 2008 000 513 A1 10/2008
DE 10 2009 031 527 B3 11/2010
(Continued)

OTHER PUBLICATIONS

International Search Report and Written Decision from the International Searching Authority dated Apr. 30, 2020 for International Application No. PCT/EP2020/053741 (16 pages).

*Primary Examiner* — George C Jin
(74) *Attorney, Agent, or Firm* — Taylor IP, P.C.

(57) ABSTRACT

A method for operating an injection system of an internal combustion engine, including: providing the injection system includes a high pressure accumulator; regulating a high pressure in the high pressure accumulator in a normal operation by way actuating a low pressure-side suction throttle; regulating the high pressure in a first operating mode of safety operation by way of actuating at least one high pressure-side pressure control valve; carrying out a switchover from the normal operation into the first operating mode of safety operation if the high pressure reaches or exceeds a first limit pressure value; and carrying out a switchover from the first operating mode of safety operation into the normal operation if, starting from above a setpoint pressure value, the high pressure reaches or undershoots the setpoint pressure value, which is lower than the first limit pressure value.

11 Claims, 11 Drawing Sheets

(51) Int. Cl.
*F02D 41/22* (2006.01)
*F02M 63/02* (2006.01)

(58) Field of Classification Search
CPC .... F02D 2041/1409; F02D 2200/0602; F02M 55/025; F02M 63/023; F02M 63/025
See application file for complete search history.

(56) References Cited

U.S. PATENT DOCUMENTS

| | | | | |
|---|---|---|---|---|
| 2009/0223488 | A1* | 9/2009 | Dolker | F02D 41/3845 123/456 |
| 2012/0166063 | A1* | 6/2012 | Dolker | F02M 63/025 701/102 |
| 2012/0215424 | A1* | 8/2012 | Dolker | F02D 41/3863 701/104 |
| 2012/0265424 | A1 | 10/2012 | Dolker | |
| 2017/0067409 | A1* | 3/2017 | Dölker | F02D 41/3863 |
| 2018/0010542 | A1* | 1/2018 | Dolker | F02D 41/3863 |
| 2021/0372343 | A1* | 12/2021 | Dolker | F02M 55/025 |
| 2022/0042476 | A1* | 2/2022 | Dolker | F02D 41/22 |

FOREIGN PATENT DOCUMENTS

| | | | |
|---|---|---|---|
| DE | 10 2009 031 528 | B3 | 11/2010 |
| DE | 10 2009 031 529 | B3 | 11/2010 |
| DE | 10 2013 202 266 | A1 | 8/2014 |
| DE | 10 2014 213 648 | B3 | 10/2015 |
| DE | 10 2015 209 377 | A1 | 11/2016 |
| EP | 1 088 981 | A2 | 4/2001 |

* cited by examiner

METHOD FOR OPERATING AN INJECTION SYSTEM OF AN INTERNAL COMBUSTION ENGINE, AN INJECTION SYSTEM FOR AN INTERNAL COMBUSTION ENGINE, AND AN INTERNAL COMBUSTION ENGINE INCLUDING AN INJECTION SYSTEM

CROSS REFERENCE TO RELATED APPLICATIONS

This is a continuation of PCT application No. PCT/EP2020/053741, entitled "METHOD FOR OPERATING AN INJECTION SYSTEM OF AN INTERNAL COMBUSTION ENGINE, AN INJECTION SYSTEM FOR AN INTERNAL COMBUSTION ENGINE, AND AN INTERNAL COMBUSTION ENGINE COMPRISING SUCH AN INJECTION SYSTEM", filed Feb. 13, 2020, which is incorporated herein by reference.

BACKGROUND OF THE INVENTION

1. Field of the Invention

The present invention relates to an internal combustion engine, and, more particularly, to an injection system.

2. Description of the Related Art

The invention relates to a method for operating an injection system of an internal combustion ending, an injection system for an internal combustion engine, and an internal combustion engine including such an injection system.

Injection systems and methods to operate same are known for example from DE 10 2014 213 648 B3 and DE 10 2015 209 377 B4.

An injection system of the type described herein includes at least one injector which is designed in particular to supply fuel into a combustion chamber of an internal combustion engine; and a high pressure accumulator which, on the one hand is connected fluidically with the at least one injector and on the other hand via a high pressure pump with a fuel reservoir. In this manner, propellant, or fuel—wherein these terms are used synonymously—can be moved by way of the high pressure pump out of the fuel reservoir into the high pressure accumulator. A low pressure side suction throttle is allocated to the high pressure pump. The suction throttle can in particular be actuated as a first pressure regulating element and is arranged in fluidic connection between the fuel reservoir and the high pressure accumulator, optionally upstream from the high pressure pump. The flow rate of the high pressure pump can thus be influenced via the suction throttle, as can at the same time the pressure in the high pressure accumulator. In addition, the injection system includes at least one high pressure side pressure control valve, via which the high pressure accumulator is fluidically connected with the fuel reservoir—in particular parallel to the flow path created by the high pressure pump. Fuel can thus be diverted from the high-pressure accumulator into the fuel reservoir via the pressure valve.

In the fluidic connection between the fuel reservoir and the high pressure accumulator a fuel filter can be provided which serves to filter water out of the fuel. However, at the same time air is thereby filtered from the fuel which can accumulate in the flow path to the high pressure accumulator, so that an air column forms. The air can again be pumped together with the fuel via the high pressure pump into the high pressure accumulator, where it can lead to undesirable pressure oscillations. It is thereby in particular possible that due to these undesirable oscillations, the high pressure in the high pressure accumulator exceeds a first pressure limit value.

Within the scope of a method for operating an injection system it is provided that the high pressure in the high pressure accumulator is regulated in normal operation by way of actuation of the low pressure side suction throttle, whereby the high pressure is regulated in a first operating mode of a safety operation by way of actuation of at least one high pressure side pressure control valve. Switching over from normal operation into the first operating mode of the safety operation occurs if the high pressure reaches or exceeds the first limit value. Since this represents a safety mechanism, it is typically provided that safety operation is maintained until the internal combustion engine including the injection system is shut off. If there is no actual error present and the first limit value was exceeded only momentarily due to undesirable pressure oscillations, continued regulating of the pressure via the first pressure control valve is proven disadvantageous, in particular since the fuel in this operating mode is excessively heated, causing the efficiency of the internal combustion engine to drop and emissions to increase.

What is needed in the art is to create a method for operating an injection system, an injection system for an internal combustion engine, and an internal combustion engine including such an injection system where the aforementioned disadvantages do not occur.

SUMMARY OF THE INVENTION

The present invention provides, in the scope of a method for operating an injection system, switching from the first operating mode of safety operation into normal operation occurs if, starting from above a pressure value, in particular the first pressure target value, the high pressure reaches or falls short of the target pressure value, wherein the target pressure value is lower than the first limit pressure value. In this manner a return of the injection system from safety operation into normal operation is made possible before the internal combustion engine is shut off, in other words, during running operation of the internal combustion engine. The fact that the high pressure again reaches or falls short of the pressure target value from above same, in particular when starting from first pressure limit value, indicates that no technical problem or defect of the injection system persists permanently, but instead that exceeding the first pressure limit is based on a temporary non-critical occurrence, for example an undesirable high pressure oscillation, so that safety operation can be safely exited in order to return to normal operation. Disadvantages resulting in particular from the operation of the injection system in safety operation—such as impermissible heating of the fuel—can thereby be avoided. In particular, in the case of high pressure oscillations which are due to air in the injection system, the latter changes only briefly into safety operation and—in particular if the air is removed from the high pressure accumulator due to deactivation of the pressure control valve—can subsequently return to normal operation wherein the high pressure is regulated by way of the suction throttle as the first pressure regulating element. Thus, unnecessary heating of the fuel and unnecessary load on the pressure valve are avoided. The lifespan of the internal combustion engine is extended, and the efficiency is improved. Moreover, emissions are reduced.

The pressure target value is in particular a high pressure value to which the high pressure in the high pressure accumulator is regulated according to requirements.

In the first operating mode of the safety operation, the at least one pressure control valve is actuated, in particular as second pressure regulating element in order to regulate the high pressure.

In normal operation a high pressure disturbance value is produced by way of the at least one pressure control valve in order to stabilize the high pressure control.

The high pressure accumulator can be designed in the embodiment of a common high pressure accumulator with which a plurality of injectors are fluidically connected. Such a high pressure accumulator is also referred to as a rail, whereas the injection system can be designed as a common rail injection system.

For comparison with the first pressure limit value a dynamic rail pressure can be used which results from a filtration of the high pressure, measured by way of a high pressure sensor, in particular with a comparable short time constant. Alternatively it is also possible to compare the measured high pressure directly with the first pressure limit value. In contrast, filtering has the advantage, that brief overshoots above the first pressure limit value do not directly result in switching into the first operating mode of the safety operation.

It is possible that the injection system includes exactly one high pressure side pressure control valve. Alternatively it is however also possible that the injection system includes a plurality of high pressure side pressure control valves and that, in an optional design it includes exactly two high pressure side pressure control valves. It is therein possible that, in the first operating mode of the safety operation a plurality of high pressure side pressure control valves, in particular both high pressure side pressure control valves, are actuated as pressure regulating elements in order to regulate the high pressure in the high pressure accumulator. According to an optional arrangement it is provided that the first operating mode of the safety operation is divided into a first operating mode range of the first operating mode in which precisely one first high pressure side pressure control valve is actuated as a pressure regulating element in order to regulate the high pressure, wherein via at least one other high pressure side pressure control valve a high pressure disturbance variable can be generated to stabilize regulation. In a second operating mode range of the first operating mode at least one second pressure control valve of the plurality of pressure control valves is actuated in addition to the first pressure control valve as a pressure regulating element, in order to regulate the high pressure in the high pressure accumulator. Pressure based switching can occur between the first operating mode range and the second operating mode range. It is optional to change from the first operating mode range to the second operating mode range if the high pressure reaches or exceeds an operating mode range change pressure limit value that is greater than the first pressure limit value. In this way the at least one second pressure control valve can be used for regulating, if control via the first pressure control valve is no longer sufficient in order to control the high pressure, in particular because sufficient fuel cannot be removed from the high pressure accumulator.

According to a further development of the present invention it is provided that an integral part for a high pressure controller that is designed for actuation of the suction throttle for regulating the high pressure during normal operation is initialized with an integral initial value, when switching over from first operating mode of safety operation into normal operation. The integral initial value is thereby determined as a leakage value of the injection system, depending on a current operating point of the internal combustion engine. Thus, it is advantageously ensured that the suction throttle is suitably controlled by the high pressure regulator immediately after switching over to normal operation, in particular in such a way that an operating point dependent leakage of the injection system can be compensated for by delivering an adjusted amount of fuel into the high pressure accumulator. Otherwise, due to the interruption of the high pressure control by the high pressure regulator in the first mode of safety operation, there would be a risk that the regulator would actuate the suction throttle in an inappropriate way immediately after switching to normal operation, so that either too little or too much fuel would be moved into the high-pressure accumulator.

An operating point of the internal combustion engine in this case is understood to be in particular a pair of values of a current speed of the internal combustion engine, as well as a value determining the current performance of the internal combustion engine, in particular a current torque, a current performance, or a current injection volume of fuel. It is thereby apparent that the current fuel leakage from the high pressure accumulator is dependent on the one hand from the speed and on the other hand from the current performance since these are the primary values which determine how much fuel flows out of the high pressure accumulator.

According to a further embodiment of the present invention, the integral initial value is determined by reading out a leakage value from a leakage characteristics diagram of the internal combustion engine depending the current operating point. This provides an especially simple method of determining the leakage value. According to one embodiment it is possible to use the leakage value as the leakage characteristic value. In particular it is possible to use the leakage value directly as the integral initial value for initialization of the high pressure regulator. No further calculation steps are necessary in this case, so that the method is especially simple. Alternatively, it is possible that the leakage value is offset by at least one control factor to obtain the leakage characteristic value. This makes it possible to additionally influence the control behavior of the high pressure regulator, in particular to influence a transient oscillation of the high pressure on the pressure target value. The control factor can be chosen to be less than 1, in particular 0.8, in order to cause the high pressure to undershoot the pressure setpoint when switching from the first mode of safety operation to normal operation and thus to ensure a robust transition to high pressure control by way of the suction throttle as a pressure regulating element.

According to a further development of the present invention it is provided that a constant characteristics diagram is used as the leakage characteristics diagram. The leakage characteristics diagram can thus be assigned data once in an especially simple manner. The leakage characteristics diagram can be provided with data received in bench tests. Alternatively or in addition the leakage characteristics diagram is updated during operation of the injection system. In this way it is advantageously possible to keep the leakage characteristics diagram always up to date and thus to adapt it in particular to changed operating conditions of the internal combustion engine, for example to aging effects or similar situations. During normal operation the leakage characteristics diagram i can be provided with current data as the leakage values of the integral part of the high pressure regulator. For this, values of the integral part can be used from stationary operating points of the internal combustion engine. The integral part of the high pressure regulator in stationary operation corresponds herein at least substantially to the current leakage of the injection system and is thus especially suitable for parameterizing of the leakage characteristics diagram. It also clearly simplifies use of the leakage characteristics diagram within the scope of the herein suggested method, if values of the integral part are stored in same and which can then be used again easily to initialize the integral part for the high pressure regulator, in other words can be used as integral initial values. It is thereby possible that the current integral parts are offset with at least one factor before being stored in the leakage characteristics diagram, in particular to compensate for possible effects which occur in subsequent application of factors on the leakage values after they have been read out from the leakage characteristics diagram. The leakage characteristics diagram can be provided data of filtered values of the current integral part. This advantageously allows for filtering out brief fluctuations; in this respect a low-pass filtering is applied.

According to a further development of the present invention it is to be verified whether the suction throttle is defective before switching from the first operating mode of the safety operation into normal operation. Switching into normal operation occurs then only when no suction throttle defect is detected, or—in other words—if it is determined that the suction throttle can function properly. This advantageously avoids that switching into normal operation possibly occurred, even though a defect is present and that there is no assurance that the high pressure during normal operation is in fact being controlled. Thus, switching into normal operation occurs advantageously only if it has been effectively ensured that the suction throttle for control of the high pressure during normal operation can be actuated. Thus, damage to the internal combustion engine can be avoided.

In the first operating mode of the safety operation the suction throttle can be continuously open.

According to a further development of the present invention it is provided that switching into a second operating mode of the safety operation occurs when the high pressure exceeds a second pressure limit value, wherein in the second operating mode of the safety operation the at least one pressure control valve and the suction throttle are continuously open. The second pressure limit value is in particular greater than the first pressure limit value and can be greater than the operating mode change pressure limit value. In the second operating mode of the safety operation it is ensured that, in the event of the pressure being too high in the high pressure accumulator, a sufficient amount of fuel can permanently be removed from the high pressure accumulator by way of permanently opening the at least one pressure control valve. In order to protect the injection system and the internal combustion engine from excessively high pressure, control of the high pressure is thus being dispensed with. At the same time, the suction throttle is permanently opened in order to ensure that also in the medium performance range and at low load points of the internal combustion engine—when the high pressure pump operates at low speed—sufficient fuel is delivered into the high pressure accumulator, so that the operation of the internal combustion engine is not interrupted by insufficient fuel delivery. Due to the permanent leakage out of the high pressure accumulator via the permanently opened pressure control valve it could otherwise cause a deficiency in fuel supply to the combustion chambers, so that the internal combustion engine would eventually stall. The second operating mode of safety operation represents in particular a safety function which is to ensure an as defect-free continued operation of the internal combustion engine as possible in an emergency operation mode, in particular in order to provide a so-called limp-home function. Notably, the at least one pressure control valve can herein fulfil the function of a pressure relief valve, so that a mechanical pressure relief valve can advantageously be dispensed with.

According to one embodiment it is possible that the pressure control valve and/or the suction throttle are actively permanently opened, in other words are controlled in a permanently open condition. According to an alternative embodiment it is possible, that the pressure control valve and/or the suction throttle are passively permanently opened. This is possible in particular, if at least one of these elements is designed to be open when not energized. In this case the corresponding element is optionally not actuated, so that it is permanently open, particularly completely open. It is also possible that the at least one pressure control valve is designed to be closed when not energized and not under pressure, however, to be open without current, but when under pressure. This means that the pressure control system in a condition where it is not energized and not under pressure is closed, but wherein it opens in the deenergized condition at a predetermined limit opening pressure value. In this case the pressure control valve can be permanently open in the second operating mode of safety operation without actuation since the high pressure in the high pressure accumulator maintains it in the open position. Moreover, in a start operation of the internal combustion engine the pressure control valve can—when sufficient high pressure is not yet built up in the high pressure accumulator—be closed when deenergized, which enables faster pressure build-up, without having to actively actuate the pressure control valve in a closed condition. Actuation of the pressure control valve under pressure causes closing of the pressure control valve.

One embodiment of the method is optional which is characterized in that a normal function is established in normal operation for the pressure control valve, wherein the pressure control valve is actuated as a function of a target flow. In normal operation, the normal function provides an operating mode for the pressure control valve wherein the latter creates the high pressure disturbance value in that it moves fuel out of the high pressure accumulator into the fuel reservoir.

Optionally, the normal function is set for the pressure control valve also in first operating mode of safety operation, so that the pressure control valve is actuated depending on a target volume flow. Normal operation on the one hand and first operating mode of the safety range on the other hand differ in this case in the manner in which the target volume flow for actuation of the pressure control valve is calculated.

In normal operation, the target volume flow can be calculated from a statistic and a dynamic target volume flow. The statistic target volume flow in turn can be calculated depending on a target injection volume and a speed of the internal combustion engine, via a target volume flow characteristics diagram. In a torque-oriented structure a target torque or a target performance can be used in place of the target-injection volume. A constant leakage is reproduced via the statistic target volume flow, in that the fuel is only removed in a low load range and only in a small amount. It is therein advantageous that no significant increase in the fuel temperature and no significant reduction of the efficiency of the internal combustion engine occur. By reproducing a constant leakage for the injection system via the pressure control valve, the stability of high pressure regulating is increased in the low load range. This can be recognized for example in that the high pressure in thrust mode remains approximately constant. The dynamic target volume flow is calculated via a dynamic correction as a function of a target high pressure and an actual high pressure, or respectively from the therefrom derived control deviation. If the control deviation is negative, for example in the event of load shedding of the internal combustion engine the statistic target volume flow is corrected via the dynamic target volume flow. Otherwise, in particular with a positive control deviation no change occurs in the statistic target volume flow. A pressure increase of the high pressure is countered via the dynamic target volume flow, with the advantage that the settling time of the system can again be improved.

The procedure is described in detail in the German patent document DE 10 2009 031 529 B3.

In the first operating mode of safety operation the target volume flow is calculated by a pressure control valve pressure regulator for controlling the high pressure. In this case the target volume flow represents a manipulated variable for regulating the high pressure.

Alternatively or in addition it is can be that for the pressure control valve in the second operating mode of safety operation a standstill function is set, wherein the pressure control valve is not actuated in the standstill function. This is the case in particular, when a pressure control valve is used which is open in a deactivated state or closed in a deactivated and pressure-free state. Due to the fact that the pressure control valve is then not actuated in the standstill function, in other words, that is not energized, a maximum opening of the latter results—possibly due to the high pressure applied at the input side—so that a maximum fuel volume flow is moved from the high pressure accumulator into the fuel reservoir via the pressure control valve. In this way, the pressure control valve can completely assume the functionality of an otherwise provided mechanical pressure relief valve, so that provision of the mechanical relief valve can be dispensed with. The deenergized open or pressure free and deenergized closed design of the pressure control valve has the advantage therein that it reliably opens completely even if it is no longer energized due to a defect.

A transition from normal function into standstill function can be carried out if the high pressure, in particular the dynamic rail pressure, exceeds the second pressure limit value, or when a defect in the high pressure sensor has been detected. If the high pressure sensor is defective the high pressure can no longer be regulated, and it is also no longer possible to recognize an impermissible high pressure in the high pressure accumulator. Therefore, the standstill function for the pressure control valve is established for safety reasons, so that the latter opens to a maximum, thus bringing the injection system into a safe condition that is consistent with a condition in which otherwise the mechanical pressure relief valve would open. An impermissible increase in the high pressure can thus no longer occur. The standstill function can be established based on the normal function even if a standstill of the internal combustion engine is detected. A standstill of the internal combustion engine is detected and the standstill function for the pressure control valve is set, especially if the speed of the internal combustion engine drops for a predetermined time below a predetermined value. This is the case especially if the internal combustion engine is shut off. A transition between the standstill function and the normal function occurs at a start of the internal combustion engine, such as when it is detected that the internal combustion engine is running, whereby at the same time the high pressure exceeds a start pressure value. Hence, a certain minimum pressure build up can occur initially in the high pressure accumulator before the pressure control valve is actuated in normal function to produce the high pressure disturbance value. That the internal combustion engine is running can be detected in that a predetermined speed limit is exceeded over a predetermined time period.

According to a further development of the invention it is provided that only from the first operating mode of the safety operation switching occurs back into normal operation. This means in particular that no switching occurs from the second operating mode of the safety operation back into normal operation. This accounts for the idea that the second pressure limit value can be selected such that it is exceeded by the high pressure only if in fact a serious defect is present in the injection system, so that subsequently a return into normal operation can no longer be justified. Accordingly, it is additionally optionally provided that no switching occurs from the second operating mode of safety operation into the first operating mode of safety operation. The second operating mode of the safety operation thus remains advantageously unchanged until the internal combustion engine is shut off, and optionally thereafter until it is signaled or confirmed in a suitable manner that the defect on the injection system has been removed, for example by operating a switch, an electronic input or by a similar action.

The present invention also provides an injection system for an internal combustion engine is, which includes at least one injector and a high pressure accumulator, which on the one hand is fluidically connected with the at least one injector and on the other hand is fluidically connected via a high pressure pump with a fuel reservoir, wherein a suction throttle is allocated to the high pressure pump as a first pressure regulating element. In addition, the injection system also includes at least one pressure control valve through which the high pressure accumulator is fluidically connected with the fuel reservoir. In addition, the injection system also includes a control unit that is operatively connected with the at least one injector, the suction throttle and the at least one pressure control valve—in each case for actuation of them. The control unit is arranged to carry out s method of the present invention or a method according to one of the previously described embodiments. Advantages result in particular in connection with the injection system, which have already been discussed in connection with the method.

The control unit can be designed as an engine control unit (ECU) of the internal combustion engine. Alternatively it is however also possible, that a separate control unit is provided specifically to carry out the method.

Upstream from the high pressure pump and the suction throttle, a low pressure pump can be arranged, to deliver fuel from the fuel reservoir to the suction throttle and the high pressure pump.

On the high pressure accumulator a pressure sensor can be located which is arranged to detect a high pressure in the high pressure accumulator and which is operatively connected with the control unit, so that the high pressure can be registered in the control unit. The control unit can be arranged to filter the measured high pressure, in particular for filtration with a first, longer time constant to calculate an actual high pressure that is to be used within the frame of the pressure control and can be arranged for filtration of the measured high pressure with a second, shorter time constant, in order to calculate the dynamic rail pressure.

According to one optional embodiment, the injection system includes precisely one pressure control valve.

According to another optional embodiment the injection system includes a plurality of pressure control valves, such as precisely two pressure control valves, wherein the high pressure accumulator is fluidically connected via each of the pressure control valves—optionally fluidically connected parallel to one another—with the fuel reservoir.

The at least one pressure control valve can be designed in a deenergized open manner. This design has the advantage that the pressure control valve in a case when it is not actuated or energized opens to a maximum, which ensures an especially safe and reliable operation, in particular when a mechanical pressure relief valve has been dispensed with. An impermissible rise in the high pressure in the high pressure accumulator can be avoided, even when energizing of the pressure control valve is not possible due to a technical defect.

The at least one pressure control valve can be designed in a pressure free and deenergized closed manner. It can be designed such that, with a pressure applied at the input side it is closed up to a predetermined limit opening pressure value, whereby it opens when the pressure at the input side in deenergized condition reaches or exceeds the limit opening pressure value. This results in particular in the advantages already discussed in the context of the method.

According to a further development of the present invention it is provided that the injection system does not include a mechanical pressure relief valve. As already discussed in the context of the method, its function can more advantageously be assumed by the at least one pressure control valve in the second operating mode of the safety operation.

The present invention also provides an internal combustion engine which includes the inventive injection system or an injection system according to one of the previously described design examples. The advantages that were already discussed in the context of the injection system and the method result in particular in connection with the internal combustion engine.

The internal combustion engine can have a plurality of—such as identical—combustion chambers. At least one injector of the injection system can be allocated to each combustion chamber in order to deliver fuel into the combustion chamber. The injection system thus has at least as many injectors as the internal combustion engine has combustion chambers; according to an optional embodiment in particular there are exactly as many, wherein it is however also possible that two or more injectors respectively are allocated to each combustion chamber. The combustion engine can in particular have four, six, eight, ten, twelve, fourteen, sixteen, eighteen or twenty combustion chambers. However, another, in particular smaller or greater number of combustion chambers is also possible. The internal combustion engine can be designed as a piston engine. The internal combustion engine can be designed as a diesel engine.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
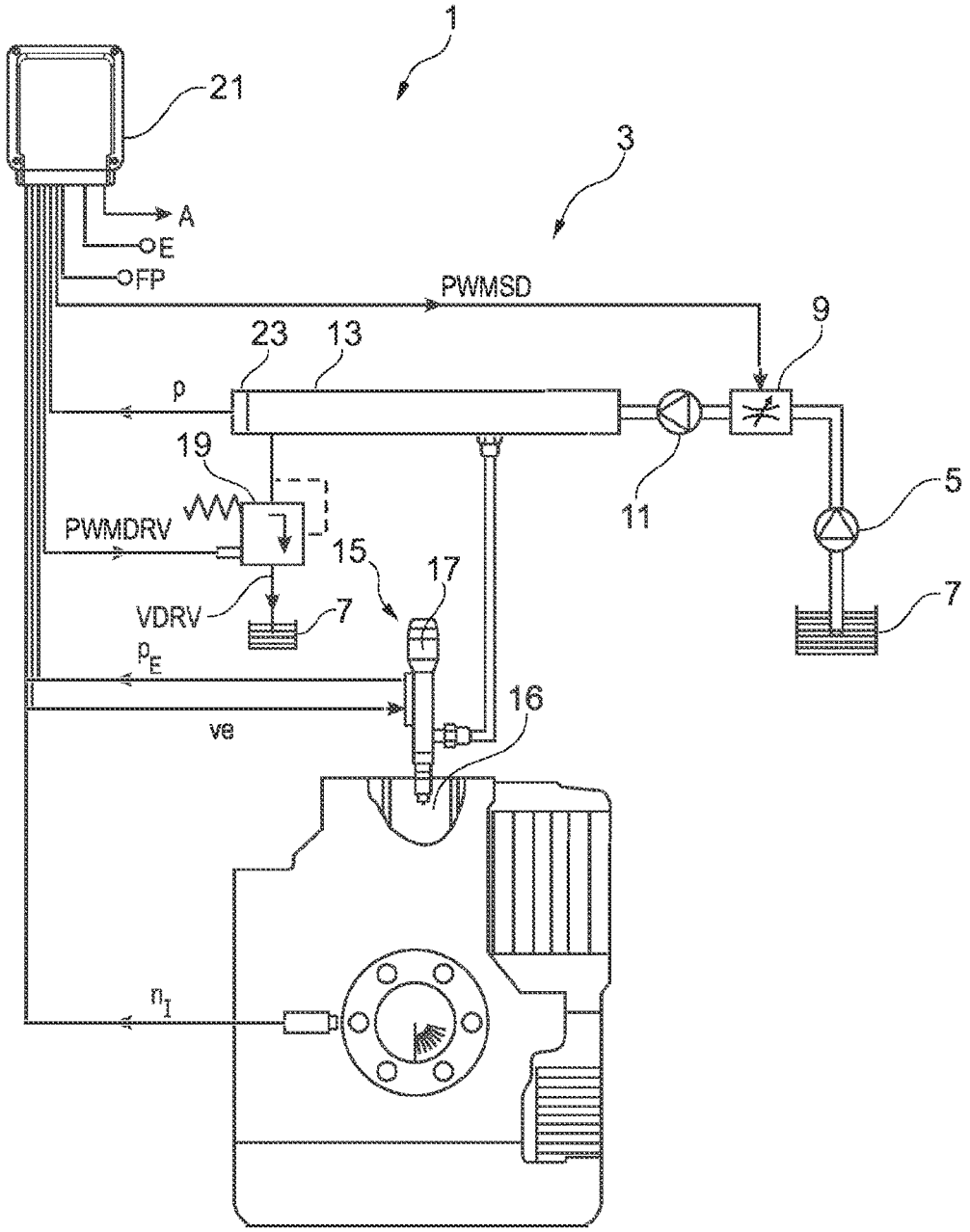
FIG. 1 is a schematic illustration of a first design example of an internal combustion engine with a design example of an injection system.

Referring now to the drawings, and more particularly to FIG. 1, there is shown a schematic representation of a first design example of an internal combustion engine 1 with a first design example of an injection system 3, according to the present invention. Injection system 3 can be designed as a common rail injection system. It includes a low pressure pump 5 to pump fuel out of a fuel reservoir 7, an adjustable, low pressure side suction throttle 9 to influence a fuel volume flow flowing through the latter, a high pressure pump 11 to pump fuel under a pressure increase into a high pressure accumulator 13, high pressure accumulator 13 to store the fuel, and a plurality of injectors 15 for injecting fuel into combustion chambers 16 in internal combustion engine 1. As an option it is possible that injection system 3 is equipped with individual injectors, wherein then, for example in injector 15 an individual accumulator 17 is integrated as an additional buffer volume. A pressure control valve 19 which is in particular electrically controlled is provided, via which high pressure accumulator 13 is fluidically connected with fuel reservoir 7. Through positioning of pressure control valve 19 a fuel volume flow is defined, which is moved out of high pressure accumulator 13 into fuel reservoir 7. This fuel volume flow is identified in FIG. 1 and in the following description with VDRV and represents a high pressure disturbance value of injection system 3.

Injection system 3 does not have a mechanical pressure relief valve which is conventionally provided, and which connects high pressure accumulator 13 with fuel reservoir 7. The mechanical pressure relief valve can be dispensed with since its function can be completely assumed by pressure control valve 19.

The operating mode of internal combustion engine 1 is determined by an electronic control unit 21, which can be designed as engine control unit of internal combustion engine 1, in particular as a so-called engine control unit (ECU). Electronic control unit 21 includes the usual components of a microcomputer system—for example a microprocessor, I/O modules, buffer, and memory modules (EEPROM, RAM). Operating data which is relevant for the operation of internal combustion engine 1 are stored in the memory modules in characteristics diagrams/characteristics curves. Based on these, electronic control unit 21 calculates output values from input values. The following input values are shown in an exemplary manner in FIG. 1: A measured, still unfiltered high pressure p prevailing in high pressure accumulator 13 and which is measured by way of a high pressure sensor 23; a current engine speed III; a signal FP for the performance specification by an operator of internal combustion engine 1; and an input value E. Under input value E, additional sensor signals are can be combined, for example a charge air pressure of an exhaust gas turbocharger. In an injection system 3 with individual accumulators 17, an individual accumulator pressure pE can be an additional input value for control unit 21.

As illustrated in FIG. 1 the following examples are shown as output values of electronic control unit 21: a signal PWMSD for actuating suction throttle 9 as a first pressure regulating element; a signal ye for actuating injectors 15—which in particular specifies an injection start and/or an injection end or also an injection duration; a signal PWMDRV for actuating pressure control valve 19 as a second pressure regulating element; and an output value A. Via the optionally pulse-width modulated signal PWMDRV the positioning of pressure control valve 19 and thereby the high pressure disturbance variable VDRV is defined. Output value A is representative for additional control signals for controlling and/or regulating internal combustion engine 1, for example for a control signal to activate a second exhaust gas turbocharger during a register charge.

Figure 2:
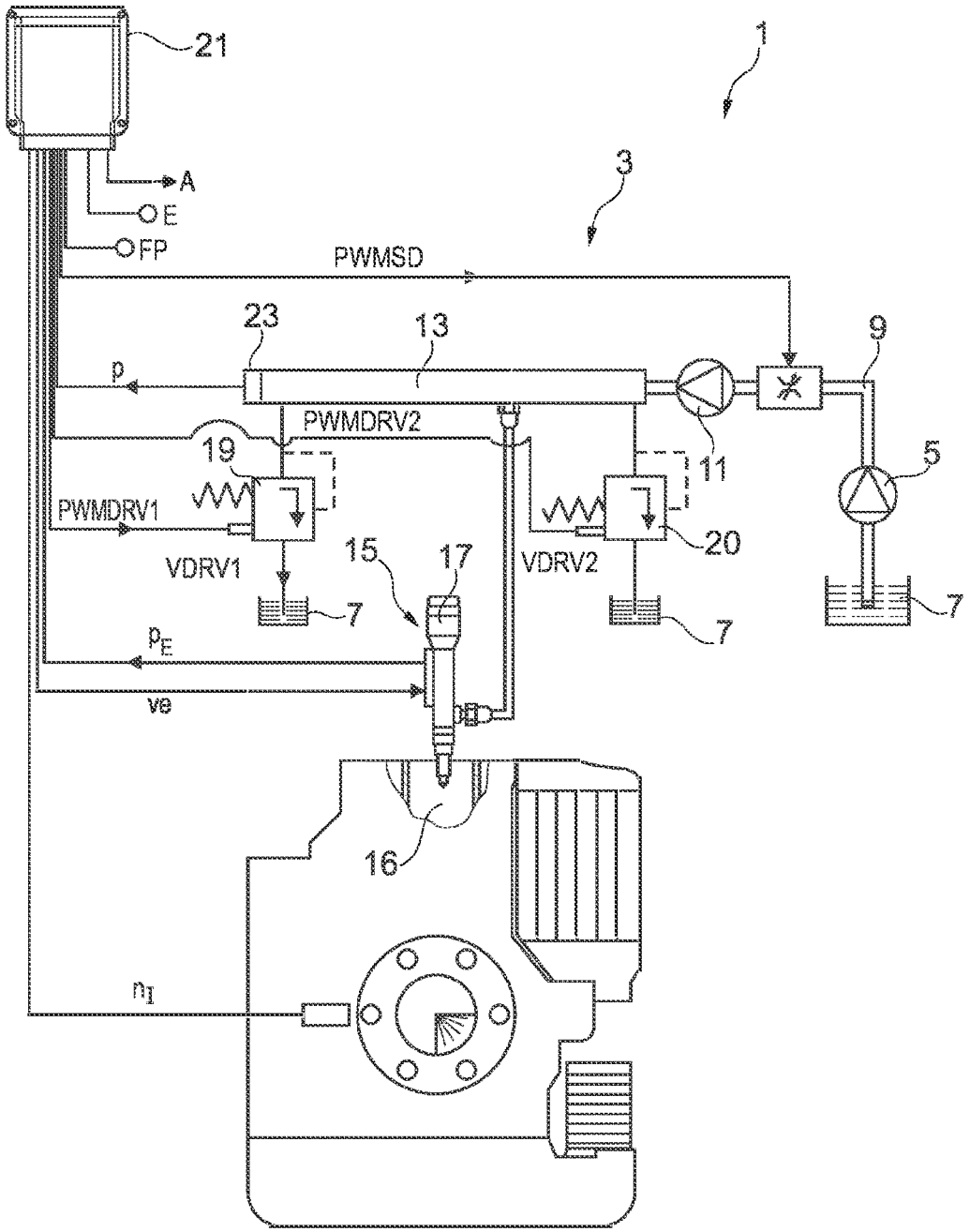
FIG. 2 is a schematic illustration of a second design example of an internal combustion engine with a second design example of an injection system.

FIG. 2 is a schematic illustration of a second design example of an internal combustion engine 1 with a second design example of an injection system 3. Here, a first, in particular electrically controllable pressure control valve 19 is provided, through which high pressure accumulator 19 is fluidically connected with fuel reservoir 7. Via the position of first pressure control valve 19 a fuel volume flow is defined, which is moved out of high pressure accumulator 13 into fuel reservoir 7. This fuel volume flow is identified in FIG. 2 with VDRV1 and represents a high pressure disturbance variable of injection system 3.

Injection system 3 herein includes additionally a second, in particular electrically controllable pressure control valve 20, via which high pressure accumulator 13 is also fluidically connected with fuel reservoir 7. The two pressure control valves 19, 20 are thus connected in particular fluidically parallel to one another. Via second pressure control valve 20 a fuel volume flow can also be defined which can be moved out of high pressure accumulator 13 into fuel reservoir 7. This fuel volume flow is identified in FIG. 2 with VDRV2.

It is possible that injection system 3 has more than two pressure control valves 19, 20.

In contrast to FIG. 1 the following examples are shown here as output values of electronic control unit 21: a first signal PWMDRV1 for actuating a first pressure control valve of the two pressure control valves 19, 90; a second signal PWMDRV2 for actuating a second pressure control valve of the two pressure control valves 19, 20. The allocation shown in FIG. 2 of first signal PWMDRV1 to first pressure control valve 19, and of second signal PWMDRV2 to second pressure control valve 20 is optionally not permanently defined, but pressure control valves 19, 20 can be actuated in an alternating manner with signals PWMDRV1, PWMDRV2. Signals PWMDRV1, PWMDRV2 are optionally pulse-width modulated signals by way of which the position of a pressure control valve 19, 20 and thereby volume flow VDRV1, VDEV2 respectively allocated to pressure control valves 19, 20 can be defined.

If second pressure control valve 20 is added, optionally only the following changes occur in the method which is described below for precisely one pressure control valve 19: second pressure control valve 20 is controlled in a normal operation and in a first operating mode range of a first operating mode of a safety operation to produce the high pressure disturbance variable. In a second operating mode range of the first operating mode of the safety operation, second pressure control valve 20 can be actuated for pressure regulating in addition to first pressure control valve 19, in particular by way of a pressure control valve-pressure regulator. In a second operating mode of the safety operation, second pressure control valve 20 is also optionally permanently open. On the basis of the following explanation in connection with first pressure control valve 19 as the only pressure control valve, this functionality is not difficult to implement. Furthermore, a corresponding use of a second pressure control valve is disclosed in German patent document DE 10 2015 209 377 B4.

For the sake of simplicity, the following will discuss the functionality of injection system 1 of the embodiment illustrated in FIG. 1, which features exactly one pressure valve 19.

Figure 3:
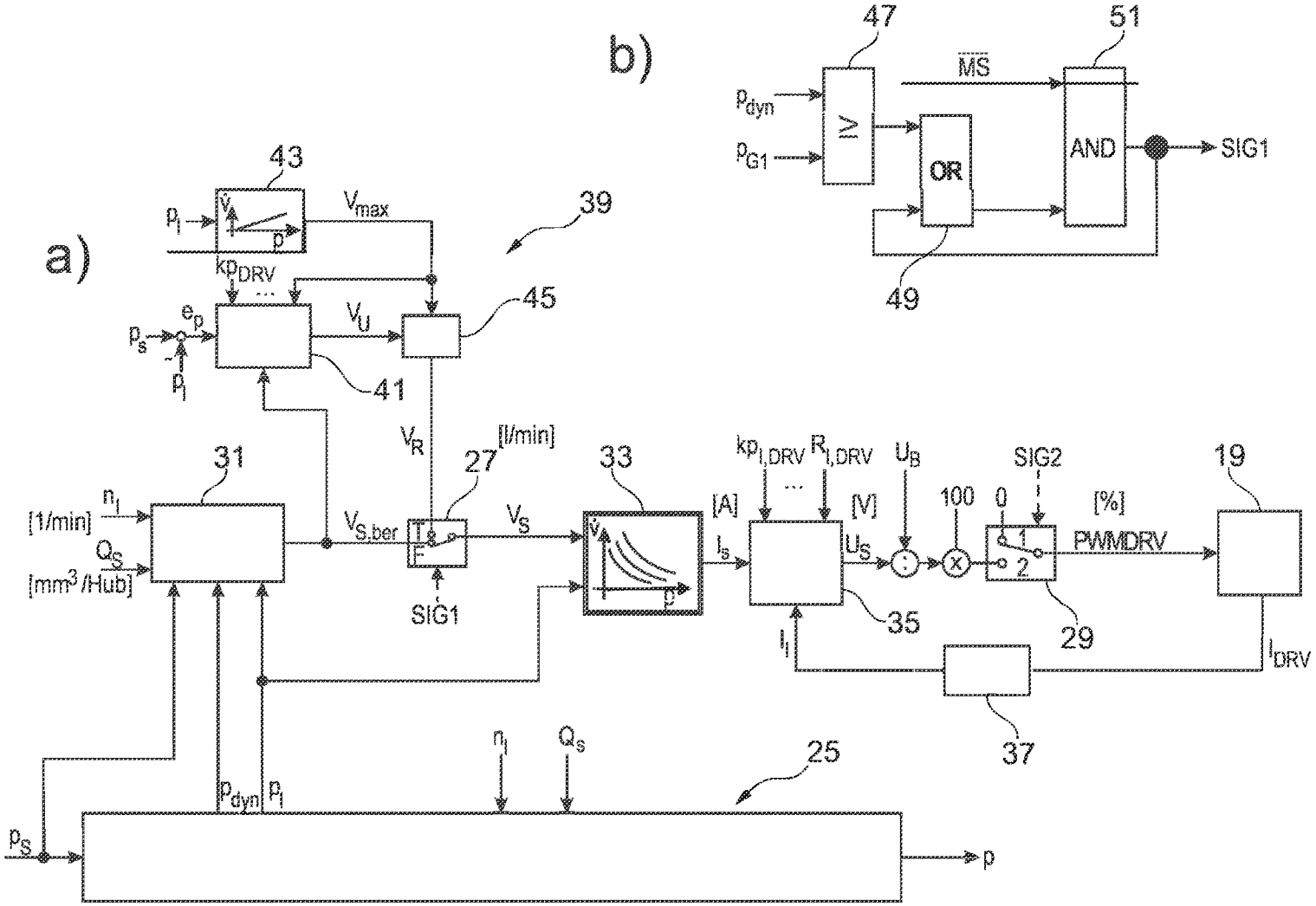
FIG. 3 is a detailed representation of a method for operating an injection system according to the state of the art.
Figure 5:
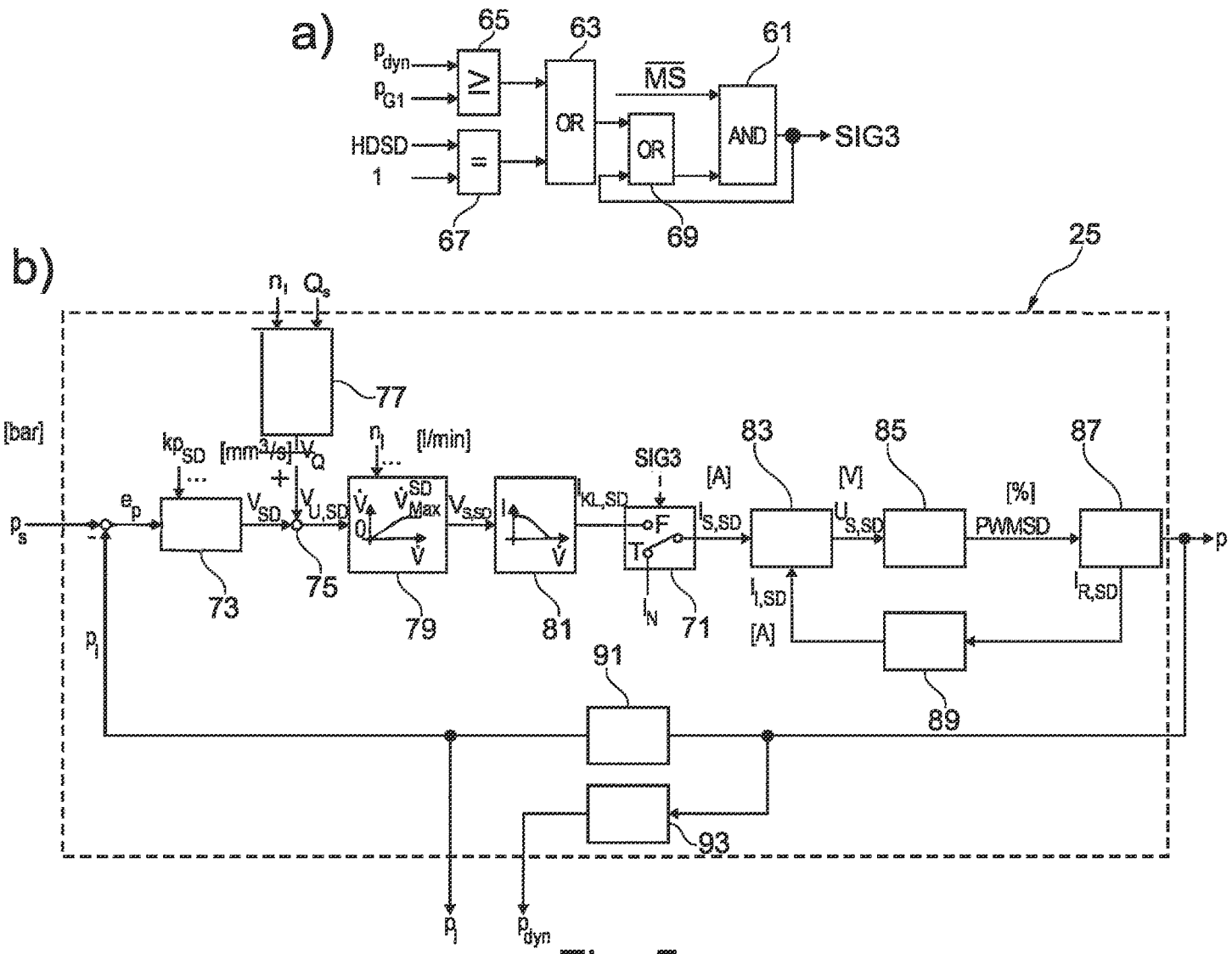
FIG. 5 is a detailed representation of a method for operating an injection system according to the state of the art.

FIG. 3 a) is a schematic illustration of an example of a method for operating injection system 3 according to FIG. 1. A first high pressure control circuit 25 is provided through which, in a normal operation of injection system 3 the high pressure in high pressure accumulator 13 is controlled by way of suction throttle 9 as the pressure regulating element. First high pressure control circuit 25 is discussed in further detail in connection with FIG. 5 where it is illustrated in detail. First high pressure control circuit 25 has a pressure setpoint $p_S$ as input value for injection system 3, which in the following description is also referred to as target high pressure $p_S$. The latter can be read out of a characteristics diagram, depending on a speed of internal combustion engine 1, a load or torque requirement on internal combustion engine 1, and/or depending on additional values which are particularly serving a correction. Additional input values of first high pressure control circuit 25 are especially the current speed $n_I$ of internal combustion engine 1 and a target injection volume Qs as calculated optionally by a speed controller. First high pressure control circuit 25 has as an output value high pressure p, which is measured in particular by high pressure sensor 23 and which can be subjected to a first filtering with a larger time constant in order to determine the actual high pressure $p_I$, whereby it can be simultaneously subjected to a second filtering having a smaller time constant, in order to calculate a dynamic rail pressure $p_{dyn}$. These two pressure values $p_I$, $P_{dyn}$ represent additional output values of first high pressure control circuit 25.

FIG. 3*a*) illustrates the actuation of pressure control valve 19. A first switching element 27 is provided with which—depending upon a first logic signal SIG1—switching between normal operation and the first operating mode of the safety operation is accomplished. First switching element 27 can be actualized entirely on an electronic or software basis. The functionality described below can be switched over depending on the value of a variable corresponding to first logical signal SIG1, which in particular is designed as a so-called flag and can accept the values "true" or "false". Alternatively, it is of course also possible that first switching element 27 is designed as a real switch, for example as a relay. This switch can then be switched, for example depending on a level of an electric signal. In the herein concretely illustrated design the normal operation is set, when first logic signal SIG1 indicates the value "false". In contrast, the first operating mode of the safety operation is set, when first logic signal SIG1 indicates value "true".

A second switching element 29 is provided, which is designed to switch the actuation of pressure control valve 19 from a normal function into a standstill function and back. Second switching element 29 is herein controlled depending on a second logic signal SIG2 or respectively depending on a value of a corresponding variable. Second switching element 29 can be designed as a virtual, in particular software-based, switching element which switches as a function of a value of a variable, designed in particular as a flag between normal function and standstill function. Alternatively it is however also possible that the second switching element is designed as a real switch, for example as a relay which switches depending on a signal value of an electric signal. In the herein concretely illustrated embodiment, second logic signal SIG2 corresponds to a time conditions variable which can assume values 1 for a first condition and 2 for a second condition. The normal function for the pressure control valve is herein set when second logic signal SIG2 assumes value 2, wherein the standstill function is set, when second logic signal SIG2 assumes value 1. Of course, a deviating definition of second logic signal SIG2 is possible, in particular in such a way that a corresponding variable can assume values 0 and 1.

First, actuation of pressure control valve 19 during normal operation, as well as in set normal function will be described. A first computation element 31 is provided which issues a calculated target-volume flow $V_{S,ber}$ as an output value, wherein the current speed $n_1$, the target injection volume Qs, the target high pressure $p_S$, the dynamic rail pressure $p_{dyn}$ and the actual high pressure $p_I$ are input into first computation element 31 as input values. The functionality of first computation element 31 is described in detail in German patent documents DE 10 2009 031 528 B3 and DE 10 2009 031 527 B3. It is shown in particular that in a low load range, for example when idling internal combustion engine 1, a positive value is calculated for a statistic target volume flow, whereas outside a low load range a statistic target volume flow of 0 is calculated. The statistic target volume flow can be corrected by adding up a dynamic target volume flow which for its part is calculated by a dynamic correction, depending on the target high pressure $p_S$, the actual high pressure $p_I$ and the dynamic rail pressure $p_{dyn}$. The calculated target volume flow $V_{S,ber}$ is the sum of the statistic target volume flow and the dynamic target volume flow. In this respect, the calculated target volume flow $V_{S,ber}$ is a resulting target volume flow.

In normal operation, when first logic signal SIG1 indicates value "false", the calculated target volume flow $V_{S,ber}$ is delivered to a pressure control valve characteristics diagram 33 as target volume flow $V_S$. As described in the German patent document DE 10 2009 031 528 B3, pressure control valve characteristics diagram 33 shows an inverse characteristic of pressure control valve 19. Output value of this characteristics diagram is a pressure control valve target current $I_S$; input values are the target volume flow $V_S$ that is to be removed and the actual high pressure $p_I$.

Alternatively it is also possible that target volume flow $V_S$ is not calculated by way of computation element 31 but is specified constantly in normal operation.

Pressure control valve target current $I_S$ is supplied to a current regulator 35 whose task it is to regulate the current for actuation of pressure control valve 19. Additional input values of current regulator 35 are for example a proportional coefficient $kp_{I,DRV}$ and an ohmic resistor $R_{I,DRV}$ of pressure control valve 19. Output value of current regulator 35 is a target voltage US for pressure control valve 19 which, in reference to an operating voltage $U_B$ is converted in a customary manner into a duty cycle for pulse-width modulated signal PWMDRV for control of pressure control valve 19 and is supplied to the latter during normal function, that is, when second logic signal SIG2 shows value 2. To regulate the current, the current is measured at pressure control valve 19 as a current value $I_{DRV}$, filtered in a first current filter 37 and again supplied to current regulator 35 as filtered actual current $I_1$.

As already indicated, duty cycle PWMDRV of the pulse-width modulated signal for controlling pressure control valve 19 is in its own right calculated in a conventional manner according to the following equation from target voltage $U_S$ and operating voltage $U_B$:

$$PWMDRV=(U_S/U_B)\times 100.$$

In this manner, a high pressure disturbance value, namely the moved target volume flow $V_S$, is produced in normal operation via pressure control valve 19.

If first logic signal SIG1 accepts value "true", first switching element 27 switches from normal operation into the first operating mode of safety operation. The conditions under which this is the case are discussed in connection with FIG. 3*b*). Regarding actuation of pressure control valve 19, no difference occurs in the first operating mode of safety operation insofar as pressure valve 19 is actuated also here with target volume flow $V_S$, at least as long as the normal function is set by switching element 29. To this extent, there is no change in FIG. 3*a*) right of switching element 27 to the previously provided explanations. Target volume flow $V_S$ is however calculated in a different manner in the first operating mode of the safety operation than it is in normal operation, namely through a second high pressure control circuit 39.

In this case, target volume flow $V_S$ is identically set with a limited output volume flow $V_R$ of a pressure control valve-pressure regulator 41. This corresponds with the upper switching position of first switching element 27. Pressure control valve-pressure regulator 41 has as an input value of a high pressure control deviation $e_p$, which is calculated as a difference of target high pressure $p_S$ and actual high pressure $p_I$. Additional input values of pressure control valve-pressure regulator 41 can be a maximum volume flow $V_{max}$ for pressure control valve 19, the target volume flow $V_{S,ber}$ calculated in first computation element 31, and/or a proportional coefficient $kp_{DRV}$. Pressure control valve-pressure regulator 41 can be designed as PI($DT_1$) algorithm. In the process, an integral part (I-part) is initialized with the calculated target volume flow $V_{S,ber}$ at the time when first switching element 27 is switched from its lower to its upper switching position as shown in FIG. 3*a*). Upward, the I-part of pressure control valve-pressure regulator 41 is limited to the maximum volume flow $V_{max}$ for pressure control valve 19. Maximum volume flow $V_{max}$ can be herein an output value of a two-dimensional characteristics curve 43 which—dependent on the high pressure—shows the maximum volume flow passing through pressure control valve 19, wherein characteristics curve 43 receives the actual high pressure $p_I$ as the input value. Output value of pressure control valve-pressure regulator 41 is an unlimited volume flow Vu, which is limited in a first limiting element 45 to maximum volume flow Vmax. First limiting element 45 ultimately issues the limited target volume flow $V_R$ as the output value. With the latter as target volume flow $V_S$, pressure control valve 19 is then actuated, in that the target volume flow $V_S$ is supplied in the already described manner to pressure control valve characteristics diagram 33.

FIG. 3 shows in illustration b) under which conditions first logic signal SIG1 accepts values "true" and "false". As long as dynamic rail pressure $p_{dyn}$ does not reach or exceed a first pressure limit value $p_{G1}$, the output of a first comparator element 47 indicates value "false". At the start of internal combustion engine 1, the value of the first logic signal SIG1 is initialized with "false". Therefore, the result of a first OR-function link 49 is also "false" as long as the output of first comparator element 47 shows value "false". The output of first OR-function link 49 feeds to an input of an AND-function link 51, to the other input of which is fed the rejection of a variable MS represented by a horizontal line, wherein variable MS indicates the value "true" when internal combustion engine 1 is stopped and the value "false" when internal combustion engine 1 is running. During operation of internal combustion engine 1, the value of the rejection of variable MS is therefore "true". Overall it is shown that the output of first OR-function link 49 and thus the value of first logic signal SIG1 is "false" as long as dynamic rail pressure $p_{dyn}$ of first pressure limit value $p_{G1}$ is not reach or exceeded.

If dynamic rail pressure $p_{dyn}$ reaches or exceeds first pressure limit value $p_{G1}$, the output of first comparator element 47 jumps from "false" to "true". Thus, the output of first OR-function link 49 also jumps from "false" to "true". Therefore however, the output of first AND-function link 51 also jumps from "false" to "true" so that the value of first logic signal SIG1 becomes "true". This value is again fed to first OR-function link 49 which however does not change that the output of the latter remains "true". Even a drop of dynamic rail pressure $p_{dyn}$ to below first pressure limit value $p_{G1}$ can no longer change the truth value of first logic signal SIG1. It remains "true" until variable MS and thus also its rejection, changes its truth value, namely when internal combustion engine no longer runs.

This shows the following: Normal operation is realized as long as dynamic rail pressure $p_{dyn}$ is below limit value $p_{G1}$. In this case, the target volume flow $V_S$ is identical to calculated target volume flow $V_{S,ber}$, since first logic signal SIG1 accepts value "false" and switching element 27 is therefore arranged in its lower position in FIG. 3. If dynamic rail pressure $p_{dyn}$ reaches or exceeds first pressure limit value $p_{G1}$, first logic signal SIG1 accepts value "true" and first switching element 27 assumes its upper switching position. Target volume flow $V_S$ in this case becomes thereby identical with limited volume flow $V_R$ of second high pressure control circuit 39. This means that, in normal operation a high pressure disturbance value is produced via pressure control valve 19, wherein the first operating mode of the safety operation is activated, when dynamic rail pressure $p_{dyn}$ reaches first pressure limit $p_{G1}$, and the high pressure is subsequently regulated by pressure control valve-pressure regulator 41. This occurs until a standstill of internal combustion engine 1 is detected, since only in this case variable MS assumes value "true", thus its rejection of value "false" and wherein ultimately first logic signal SIG1 assumes again value "false", whereby first switching element 27 is again moved into its lower switching position.

In the first operating mode of the safety operation, pressure control valve 19 takes over the regulation of the high pressure via second high pressure control circuit 39.

It also becomes clear, that no return to normal operation out of first operation mode of the safety operation is possible with this method as long as internal combustion engine 1 is running. Undesirable, air-induced oscillations of the high pressure can thus lead inconveniently to the first operating mode of the safety operation to be set, without being able to exit it again once the high pressure has dropped.

Returning to FIG. 3*a*) a second mode of operation of the safety operation is discussed below: Switching into the second operating mode occurs when second logic signal SIG2 assumes value 1. In this case, second switching element 29 is placed in its upper switching position, illustrated in FIG. 3, thereby setting a standstill function for pressure control valve 19. In this function, pressure control valve 19 is not actuated. In other words, signal PWMDRV is set to 0. Since optionally a deenergized open pressure control valve 19 is used, the latter now permanently moves a maximum fuel volume flow out of high pressure accumulator 13 into fuel reservoir 7.

If however, second logic signal SIG2 indicates a value of 2, the normal function for pressure control valve 19 is set—as already explained—the latter being controlled by way of target volume flow $V_S$ and the therefrom calculated signal PWMDRV.

Figure 4:
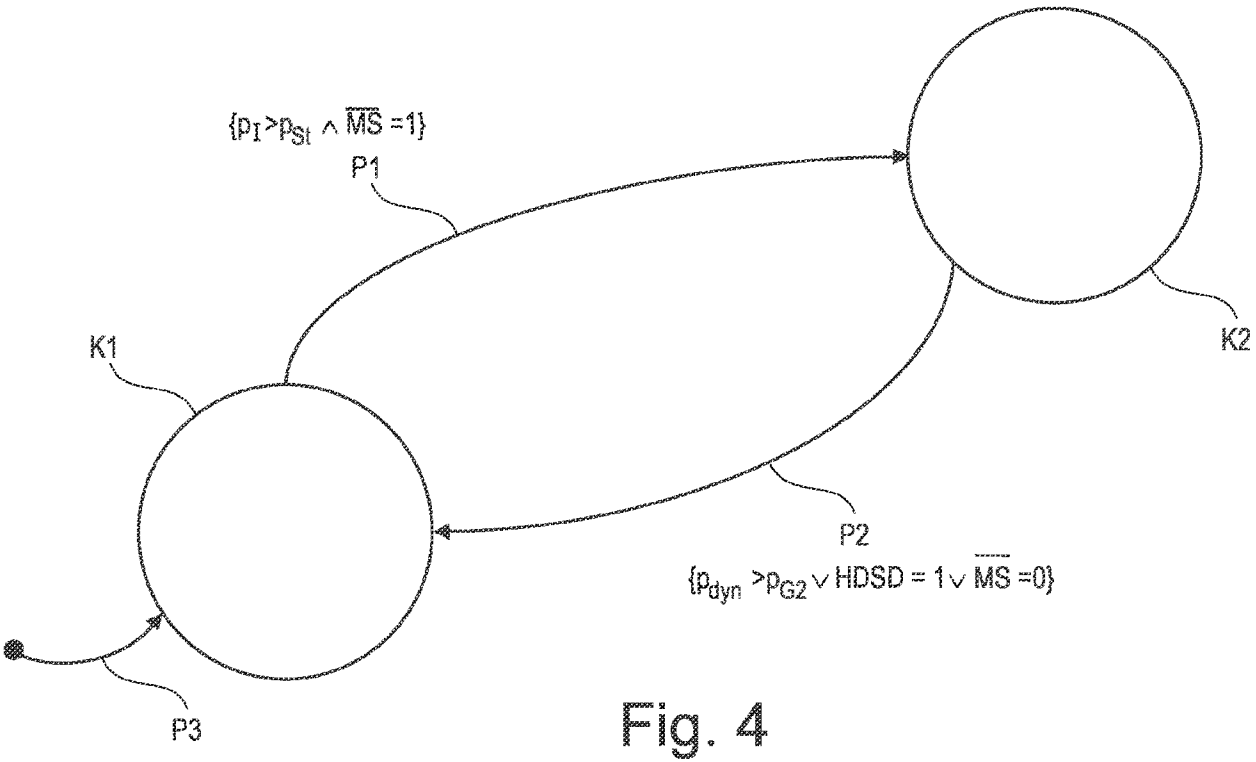
FIG. 4 is a schematic detailed representation of a method for operating an injection system.

FIG. 4 is a schematic state transition diagram for pressure control valve 19 from normal function into standstill function and back. Pressure control valve 19 can be designed in a pressure free and deenergized closed manner, whereby it is further designed such that, with a pressure applied at the input side it is closed up to a predetermined limit opening pressure value, whereby it opens when the pressure at the input side in deenergized condition reaches or exceeds the limit opening pressure value. The limit opening pressure value can for example be around 850 bar.

In FIG. 4, a first circle K1 symbolizes the standstill function, wherein the normal function is symbolized in the right upper area with a second circle K2. A first arrow P1 represents the transition between standstill function and normal function, wherein a second arrow P2 represents a transition between the normal function and the standstill function. A third arrow P3 indicates an initialization of internal combustion engine 1 after the start, wherein pressure control valve 19 is first initialized in the standstill function.

Only when a running operation of internal combustion engine 1 is detected and at the same time the actual high pressure $p_I$ exceeds a starting value $p_{st}$, the normal function for pressure control valve 19 is set, and the standstill function is reset—along arrow P1. The normal function is reset, and the standstill function is set along arrow P2, if dynamic rail pressure $p_{dyn}$ exceeds a second pressure limit value $p_{G2}$, or if a defect of a high pressure sensor—illustrated herein by a logic variable HDSD—is detected, or if it is detected that internal combustion engine 1 is stationary. Pressure control valve 19 is not actuated in the standstill function, whereas during normal function—as explained in connection with FIG. 3—it is actuated by way of target volume flow $V_S$.

The following functionality results: At the start of internal combustion engine 1, there is initially no high pressure in high pressure accumulator 13, and pressure control valve 19 is arranged in its standstill function, so that it is pressure-fee and deenergized, in other words closed. When running up internal combustion engine 1, a high pressure can quickly form in high pressure accumulator 13 which, at some time exceeds starting value $p_{st}$. This is optionally lower than the limit opening pressure value of pressure control valve 19, so that initially the normal function is set for the latter before it opens. This ensures advantageously that pressure control valve 19 is actuated when it first opens. Since it is closed in a pressure-free manner it remains closed even during actuation, until the actual high pressure $p_I$ also exceeds the limit opening pressure value, wherein it then opens and is actuated in the normal function, specifically either in normal function or in the first operating mode of the safety operation.

If however, one of the previously described cases occurs, the standstill function is again set for pressure control valve 19.

This is the case in particular, if dynamic rail pressure $p_{dyn}$ exceeds second pressure limit value $p_{G2}$, wherein this can be selected to be greater than first pressure limit value $p_{G1}$ and has a value in particular where, in a conventional design of injection system 3 a mechanical pressure relief valve would open. Since pressure control valve 19 is open in a deenergized state under pressure, it opens in this case completely in standstill function and thus fulfills the function of a pressure relief valve safely and reliably.

The transition from normal function into the standstill function also occurs if a defect is detected in high pressure sensor 23. If a defect is present here, the high pressure in high pressure accumulator 13 can no longer be controlled. In order to still be able to operate internal combustion engine 1 in a safe manner, the transition from normal function into the standstill function for pressure control valve 19 is induced, so that it opens and thereby prevents an impermissible rise in the high pressure.

The transition from normal function into the standstill function moreover occurs in a situation where a standstill of internal combustion engine 1 is detected. This corresponds to a reset of pressure control valve 19, so that during a renewed start of internal combustion engine 1 the herein described cycle can again start anew.

If the standstill function is set under pressure in high pressure accumulator 13 for pressure control valve 19, the latter is open to maximum and moves a maximum volume flow out of high pressure accumulator 13 into fuel reservoir 7. This corresponds to a safety function for internal combustion engine 1 and injection system 3, wherein this safety function can in particular replace the absence of a mechanical pressure relief valve.

It is important herein that pressure control valve 19 only has two states, specifically the standstill function and the normal function, wherein these two states are completely sufficient to represent the entire relevant functionality of pressure control valve 19, including the safety function for substitution of a mechanical pressure relief valve.

FIG. 5*a*) is a schematic illustration of a logic for calculating the value of a third logic signal SIG3 which is used to ensure that, in the first and second operating mode of the safety operation, suction throttle 9 is actuated for permanently open operation. This approach is further discussed in connection with FIG. 5*b*). The value of third logic signal SIG3 results from a second AND-link 61, into the input of which the rejection of a variable MS is again fed, wherein the result of a previous calculation—which will be discussed in further detail below—is supplied to the second input. To begin with, at the start of internal combustion engine 1, third logic signal SIG3 is initialized with value "false". The result of a second comparator element 65 is fed to a first input of a second OR-link 63, where it is determined whether dynamic rail pressure $p_{dyn}$ is greater or the same as first pressure limit value $p_{G1}$. The result from a second comparison element 67 is fed to the second input of second OR-link 63, where it is determined whether the value of logic variable HDSD which indicates a sensor defect in high pressure sensor 23 is equal to 1, whereby in this instance a sensor defect is present, and whereby no sensor defect is present if the value of variable HDSD is equal to 0. This shows that the output of second OR-link 63 assumes value "true" if at least one of the outputs of second comparator element 65 or of comparison element 67 assumes value "true". In order for the output of second OR-link 63 to assume value "true", at least one of the following conditions must be met: Dynamic rail pressure $p_{dyn}$ must have reached or exceeded first pressure limit value $p_{G1}$, and/or a sensor defect in high pressure sensor 23 must have been detected, so that variable HDSD assumes value 1. If none of these conditions are met, the output of second OR-link 63 indicates value "false".

The output of second OR-link 63 feeds into a first input of a third OR-link 69, into the second input of which the value of third logic signal SIG3 is fed. Since this is originally initialized with value "false", the output of third OR-link 69 indicates the value "false" as long as the output of second OR-link 63 assumes value "true". If this is the case, the output of third OR-link 69 also jumps to value "true". In this case, the value of second AND-link 61 also jumps to "true" if internal combustion engine 1 is running, that is, if the rejection of variable MS has value 1, so that also the value of third logic signal SIG3 jumps to "true". With FIG. 5*a*) it is shown that the value of third logic signal SIG3 remains "true" until a standstill of internal combustion engine 1 is detected, whereby in this case variable MS assumes value "true" and thus its rejection, the value "false".

FIG. 5*b*) is a schematic illustration of first high pressure control circuit 25, including a third switching element 71 to represent the permanently opened operation of suction throttle 9 in the first and second operating mode of safety operation, wherein third logic signal SIG3 feeds into third switching element 71 for control of same, the calculation of which was described in connection with FIG. 5*a*). It is possible that third switching element 71 is designed as a software switch, in other words as a purely virtual switch, as has already been described in connection with switching elements 27, 29. Alternatively, it is of course also possible that third switching element 71 is designed as an actual switch, for example as a relay.

As already explained, the input value of high pressure control circuit 25 is the target high pressure $p_S$ which, for calculating of control deviation $e_p$ is compared with the actual high pressure $p_I$. This control deviation $e_p$ is an input value of a high pressure regulator 73 that can be designed as a $PI(DT_1)$ algorithm and is discussed in further detail in connection with FIG. 10. An additional input value of high pressure regulator 73 can be a proportional coefficient $kp_{SD}$. Output value of high pressure regulator 73 is a fuel volume flow $V_{SD}$ for suction throttle 9 to which at one addition point 75, a fuel target consumption $V_Q$ is added. In a second calculation link 77, this fuel target consumption $V_Q$ is calculated depending on the current speed $n_I$ and target injection volume Qs and represents a disturbance value of first high pressure control circuit 25. As the sum of output value $V_{SD}$ of high pressure regulator 73 and disturbance value $V_Q$, an unlimited fuel target volume flow $V_{U,SD}$ results. This is limited in a second limiting element 79—depending on the current speed $n_I$—to a maximum volume flow $V_{max,SD}$ for suction throttle 9. The output of second limiting element 79 is a limited fuel target volume flow $V_{S,SD}$ for suction throttle 9, which is used as an input variable in a pump characteristics curve 81. This converts limited fuel target volume flow $V_{S,SD}$ into a characteristics curve suction throttle flow $I_{KL,SD}$.

If third switching element 71 indicates the upper switching state shown in FIG. 5*b*), which is the case if third logic signal SIG3 indicates value "false", a suction throttle target flow $I_{S,SD}$ is equated with characteristics curve-suction throttle flow $I_{KL,SD}$. Said suction throttle target flow $I_{S,SD}$ represents the input variable of a suction throttle current regulator 83 which is tasked to regulate the suction throttle current through suction throttle 9. An additional input value of suction throttle current regulator 83 is an actual suction throttle current $I_{KL,SD}$. Output value of suction throttle current regulator 83 is a suction throttle target voltage $U_{S,SD}$, which ultimately is converted in a third calculation link 85 in a known manner, into a duty cycle of a pulse-width modulated signal PWMSD for suction throttle 9. With this, suction throttle 9 is actuated, wherein the signal acts collectively on a controlled system 87, which includes in particular suction throttle 9, high pressure pump 11, and high pressure accumulator 13. The suction throttle current is measured, wherein a raw value $I_{R,SD}$ results which is filtered in a second current filter 89. Second current filter 89 can be designed as a $PT_1$-filter.

Output value of this filter is the actual suction throttle current $I_{I,SD}$ which in turn is supplied to suction throttle current regulator 83.

The control variable of first high pressure control circuit 25 is the high pressure in high pressure accumulator 13. Raw values of said high pressure p are measured by high pressure sensor 23 and filtered by a first high pressure filter element 91, which has the actual high pressure $p_I$ as the output value. Furthermore, the raw values of high pressure p are filtered by a second high pressure filter element 93, the output value of which is dynamic rail pressure $p_{dyn}$. Both filters can be implemented by a $PT_1$-algorithm, wherein a time constant of first high pressure filter element 91 is greater than a time constant of second high pressure filter element 93. In particular, second high pressure filter element 93 is a faster filter than first high pressure filter element 91. The time constant of second high pressure filter element 93 can be identical with a zero value, so that then dynamic rail pressure $p_{dyn}$ corresponds to the measured raw values of high pressure p, or respectively, is identical with them. With dynamic rail pressure $p_{dyn}$, a hydrodynamic value exists for the high pressure, which is advantageous in particular, if a faster reaction is desired for certain occurring events.

Output values of first high pressure control circuit 25 are thus the filtered high pressure values $p_I$, $P_{dyn}$, in addition to unfiltered high pressure p.

If third logical signal SIG3 assumes value "true", third switching element 71 switches into its lower switching position, as shown in FIG. 5*b*). In this case, suction throttle target current $I_{S,SD}$ is no longer identical with characteristics curve suction throttle current $I_{KL,\ SD}$ but is equated with a suction throttle emergency power IN. Suction throttle emergency power IN can have a predetermined constant value, for example 0 A, wherein then the optionally deenergized suction throttle 9 is opened to a maximum or compared to a maximum closed position of suction throttle 9 as a small current value, for example 0.5 A, so that suction throttle 9 is not completely, however largely open. Suction throttle emergency power IN and the therewith connected opening of suction throttle 9 prevents herein that internal combustion engine 1 stops if it is operated in the second operating mode of safety operation with pressure control valve 19 opened to a maximum. The opening of suction throttle 9 ensures that even in a medium to low speed range sufficient fuel is moved into high pressure accumulator 13, so that operation of internal combustion engine 1 is possible without stalling.

It becomes clear that a return from the second operating mode of safety operation into normal operation—and incidentally also into the first operating mode of safety operation—is not provided, as long as internal combustion engine 1 is running. A return into normal operation is possible only after turning off and restarting internal combustion engine 1, and optionally furthermore, only after confirmation that a possibly present defect has been eliminated.

Figure 6:
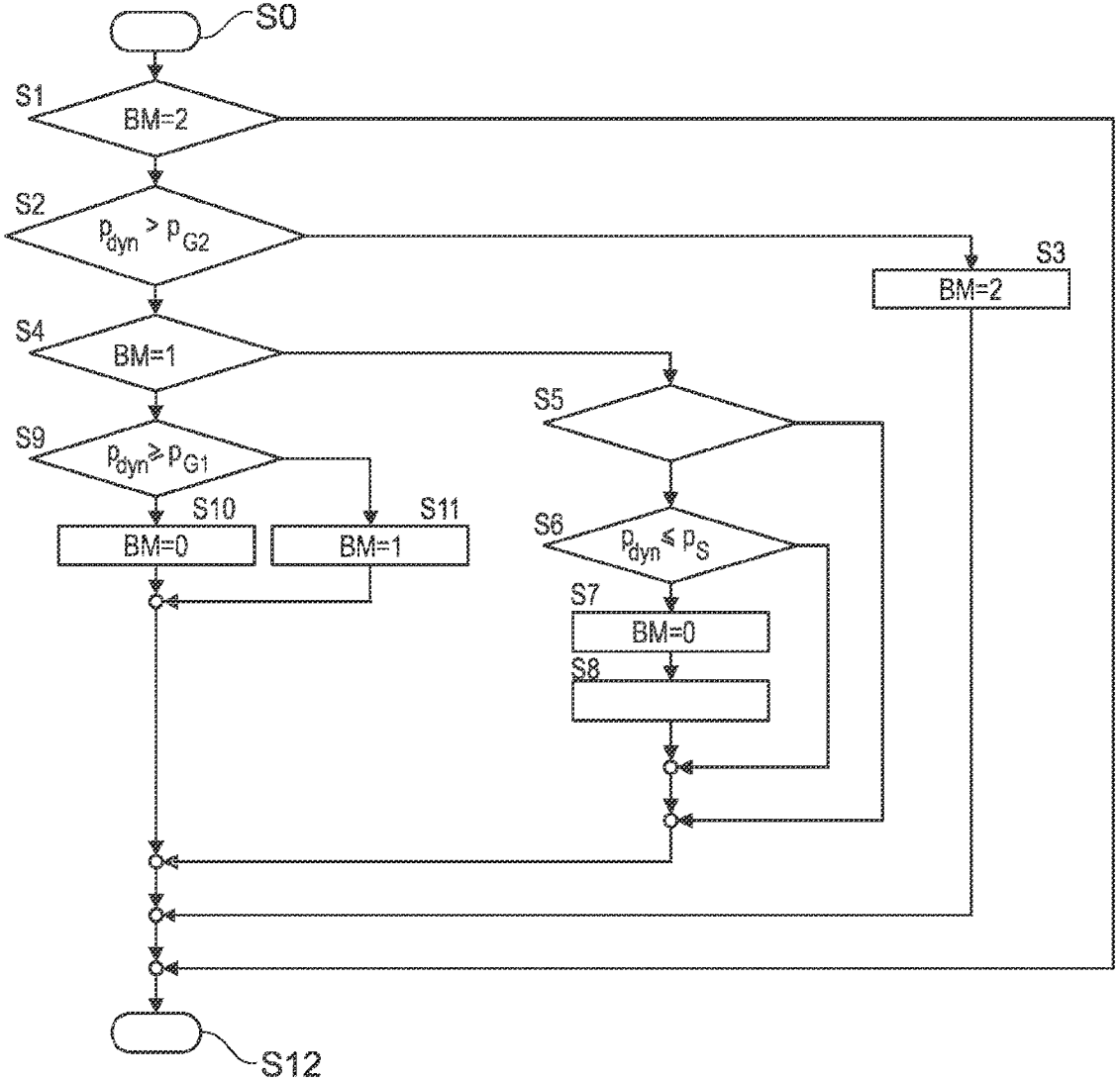
FIG. 6 is a detailed representation of a design example of a method for operating an injection system.

FIG. 6 is a schematic representation of one embodiment of a method for operating injection system 3, wherein the high pressure in high pressure accumulator 13 is regulated in normal operation by actuating low pressure side suction throttle 9, wherein the high pressure in the first operating mode of safety operation is regulated by actuating high pressure side pressure control valve 19, wherein switching occurs from normal operation into the first operating mode of safety operation when the high pressure reaches or exceeds first pressure limit value $p_{G1}$. The present invention provides that switching occurs from the first operating mode of safety operation back into normal operation if, starting from above a target pressure value $p_S$, in particular the first target pressure value $p_{G1}$, the high pressure reaches or undershoots the target pressure value $p_S$, wherein the target pressure value $p_S$ is lower than the first pressure limit value $p_{G1}$. Thus, according to the herein suggested method, a return from the first operating mode of safety operation into normal operation is advantageously possible while internal combustion engine 1 is running. In this way, it can be prevented in particular that injection system 3 is permanently operated in the first operating mode of safety operation after pressure oscillations of the high pressure due to air, which are undesirable in themselves, even though for example the air that was delivered into high pressure accumulator 13 has already escaped via pressure control valve 19.

In FIG. 6 various values of a variable BM are allocated to various operating modes. Without loss of generality, injection system 3 is operated in normal operation if variable BM has a 0 value; injection system 3 is operated in the first operating mode of the safety operation if variable BM has a value of 1; injection system 3 is operated in the second operating mode of safety operation if variable BM has a value of 2. Switching of the operating mode occurs optionally based on a change of the value of variable BM, in particular following such a change.

Switching into the first operating mode of the safety operation occurs in particular, if the high pressure exceeds second pressure limit value $p_{G2}$, wherein in the second operating mode of the safety operation, pressure control valve 19 and suction throttle 9 are permanently open.

FIG. 6 shows in particular the logic underlying the procedure for switching between the various operating modes. The process starts in a starting step S0. In a first step S1, it is queried whether variable BM has the value 2. If this is the case, the program sequence ends in a twelfth step S12.

The program sequence illustrated in FIG. 6 can be continuously iterated. This means that the program always restarts again in starting step S0 if it has completed the twelfth step while internal combustion engine 1 is running.

If it is determined in step S1, that variable BM does not have value 2, the program sequence is continued in a second step S2 where it is verified whether dynamic rail pressure $p_{dyn}$ is greater than second pressure limit value $p_{G2}$. If this is the case, the value of variable BM is set to 2 in a third step S3. Thus, switching into the second operating mode of safety operation occurs. The program sequence ends subsequently in twelfth step S12. The program sequence according to FIG. 6 shows, that a return from the second operating mode of safety operation is no longer possible, as long as internal combustion engine 1 is running. Rather, value 2 for variable BM is maintained once it has been set. At the start of internal combustion engine 1 and/or after a confirmation that a defect or malfunction of injection system 3 has been corrected, variable BM is initialized with a 0 value.

If, in contrast it is determined in the second step S2, that dynamic rail pressure $p_{dyn}$ is not greater than second pressure limit value $p_{G2}$, it is queried in a fourth step S4 whether variable BM has a value 1. If this is the case it is verified in a fifth step S5, whether suction throttle 9 is defective. If this is the case, the program sequence ends again in the twelfth step S12. If no defect on suction throttle 9 is detected in fifth step S5 the program sequence is continued in a sixth step S6 where it is determined if dynamic rail pressure $p_{dyn}$ is smaller than or equal to the target pressure value—or synonymously target high pressure—$p_S$. If this is not the case, the program sequence ends in the twelfth step S12.

If, in contrast this is the case, the program sequence is continued in a seventh step S7, where a value 0 is assigned to variable BM, thus switching operation of injection system 3 back into normal operation. It is therefore, verified in particular prior to switching from first operation mode of the safety operation into normal operation, whether suction throttle 9 is defective, wherein switching into normal operation occurs only if suction throttle 9 is not defective.

In an eighth step S8 the integral part for high pressure controller 73 is initialized with an integral initial value $I_{init}$, as explained in further detail in connection with FIG. 10. Integral initial value $I_{init}$ is determined in particular as leakage characteristics value of injection system 3, depending on a current operating point of internal combustion engine 1, which is discussed in connection with FIG. 7. After eighth step S8 the process ends in twelfth step S12.

If it is determined in fourth step S4, that the value of variable BM is not equal to 1, the program sequence is continued in a ninth step S9 where it is verified whether dynamic rail pressure $p_{dyn}$ is greater than or equal to first pressure limit value $p_{G1}$. If this is the case, the value of variable BM is set to 1 in an eleventh step S11 and thereby switched into the first operating mode of safety operation. If, in contrast the result of the query in the ninth step S9 is negative, the value of variable BM is set to 0 in tenth step S10. According to another embodiment, tenth step S10 can be omitted since, after querying in first step S1 and in fourth step S4 only value 0 remains as set for variable BM, thus not requiring a renewed setting of this value. Nevertheless, tenth step S10 can be provided in particular for safety and redundancy reasons. After eleventh step S11 or tenth step S10 respectively, the program sequence ends again in twelfth step S12.

The program sequence according to FIG. 6 also shows that switching occurs only out of first operating mode of safety operation back into normal operation. In particular, as already explained, the program does not switch back to normal operation from the second operating mode as long as internal combustion engine 1 is running.

Figure 7:
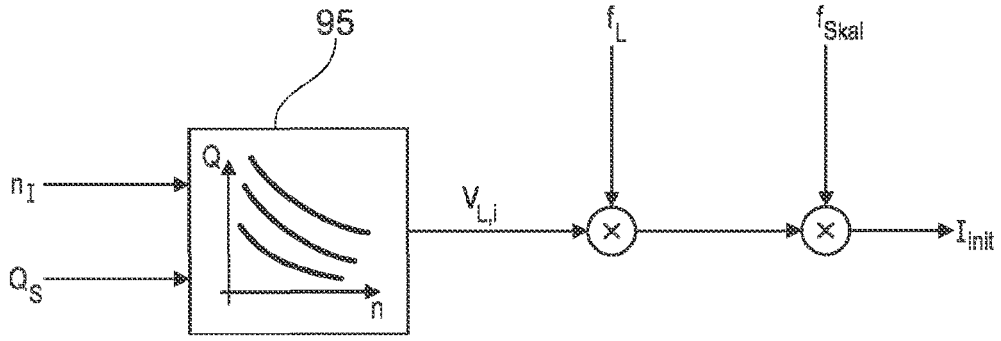
FIG. 7 is a detailed representation of a design example of a method for operating an injection system.

FIG. 7 is a schematic representation of the procedure to determine the integral initial value $I_{init}$ for high pressure regulator 73 in the eight step S8 of the program sequence according to FIG. 6. Since, in an optional embodiment, high pressure regulator 73 is designed as a PI($DT_1$) algorithm its output variable $V_{SD}$ in stationary operation is identical with the integral part of high pressure regulator 73. In order to obtain an approximate value for this output variable $V_{SD}$ during the transition from the first operating mode of the safety operation into normal operation, several suitable values—as discussed below—are stored in a leakage characteristics diagram 95 depending on a current operating point of internal combustion engine 1. In the illustrated design example the current operating point is characterized on the one hand by the current speed $n_I$ and on the other hand by the target injection volume $Q_S$. Instead of the target injection volume $Q_S$ another performance determining variable can also be used, for example a target torque or a target performance. From a physical point of view, integral part of high-pressure regulator 73 corresponds approximately to the current operating point-dependent leakage of injection system 3. Therefore, depending on the operating point an initial leakage volume flow $V_{L,i}$ can be read out from the leakage characteristics diagram 95 as a leakage value. According to one embodiment this can be used directly as a leakage characteristics value and thus as integral initial value $I_{init}$. In the herein illustrated design example it is however provided that the leakage value is offset with at least one control factor $f_L$, in order to obtain the leakage characteristics value. Control factor $f_L$ is herein selected optionally smaller than 1, in particular 0.8 to achieve an undershoot of the high pressure to below the pressure target value $p_S$ during the transition from the first operating mode of safety operation into normal operation and to thereby enable a robust transition into normal operation. Moreover, in the herein illustrated design example a scaling factor $f_{Skal}$ is used on the leakage characteristics value in order to ultimately obtain the integral initial value $I_{init}$. This scaling factor $f_{Skal}$ can serve for example to convert physical units into each other, in particular if high pressure regulator 73 requires other entities for the integral initial value $I_{init}$ than are used for leakage characteristics diagram 95.

Leakage characteristics diagram 95 can be assigned data and can then be used as a constant characteristics diagram. It is in particular also possible that leakage characteristics diagram 95 is provided with data of measured values for the integral part of high pressure regulator 73 from test bench trials on an optionally mint condition engine. Alternatively it is possible that leakage characteristics diagram 95 is updated during operation of injection system 3, wherein it can be assigned data of current values, optionally filtered values of the integral part of high pressure regulator 73 as leakage values, if necessary taking into account unit conversion factors.

Leakage characteristics diagram 95 can thus always be maintained in a current state and can in particular also consider ageing effects of injection system and/or internal combustion engine 1.

Figure 8:
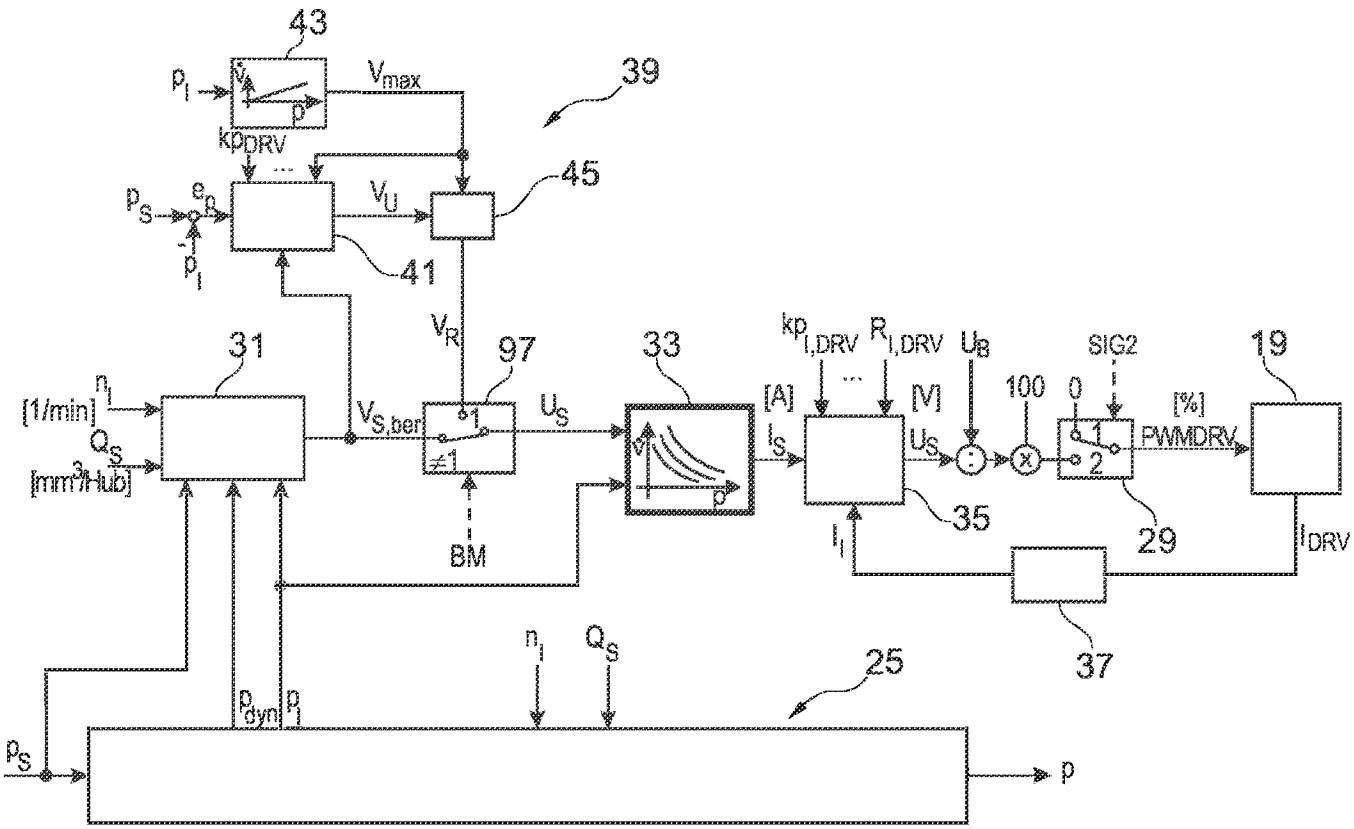
FIG. 8 is a detailed representation of a design example of a method for operating an injection system.

FIG. 8 is an additional detailed representation of one embodiment of the method for operating injection system 3, in particular of the actuation of pressure control valve 19. The illustration according to FIG. 8 is based on the illustration in FIG. 3*a*) with the following modifications, wherein other than that reference is made to FIG. 3*a*). First switching element 27 is here replaced by a first operating mode-switching element 97. Actuation of pressure control valve 19 now no longer occurs as a function of first logic signal SIG1 but rather depending on the current value of variable BM. If the latter indicates value 1, in other words, if the first operating mode of safety operation is set; first operating mode switching element 97 assumes the upper switching position as illustrated in FIG. 8, whereby in this case the high pressure is controlled by way of pressure control valve 19, as discussed in connection with FIG. 3*a*). If, in contrast, the value of variable BM is unequal to 1—in other words equal to 0 or equal to 2, whereby, accordingly normal operation or the second operating mode of the safety operation is set—first operating mode switching element 97 assumes the lower switching position illustrated in FIG. 8, whereby pressure control valve 19 either produces the high pressure disturbance value in normal operation or, in the second operating mode of the safety operation, pressure valve 19 is not actuated and thus, due to the prevailing high pressure is permanently open. This depends again on the value of second logic signal SIG2 by which it is decided whether the normal function of the standstill function is set for pressure control valve 19, as discussed in connection with FIGS. 3*a*) and 4, wherein especially the state transition diagram according to FIG. 4 indicates in which manner the value for second logic signal SIG2 is selected. This is in particular equal to 1 in the standstill function and equal to 2 in normal function of pressure control valve 19.

Thus, it also becomes clear from FIG. 8 that, according to the herein disclosed technical teachings, a return from the first operating mode of the safety operation into normal operation during operation of internal combustion engine 1 is possible if the value of variable BM is reset from 1 back to 0 and the switching position of first operating mode switching element 97 changes accordingly.

Figure 9:
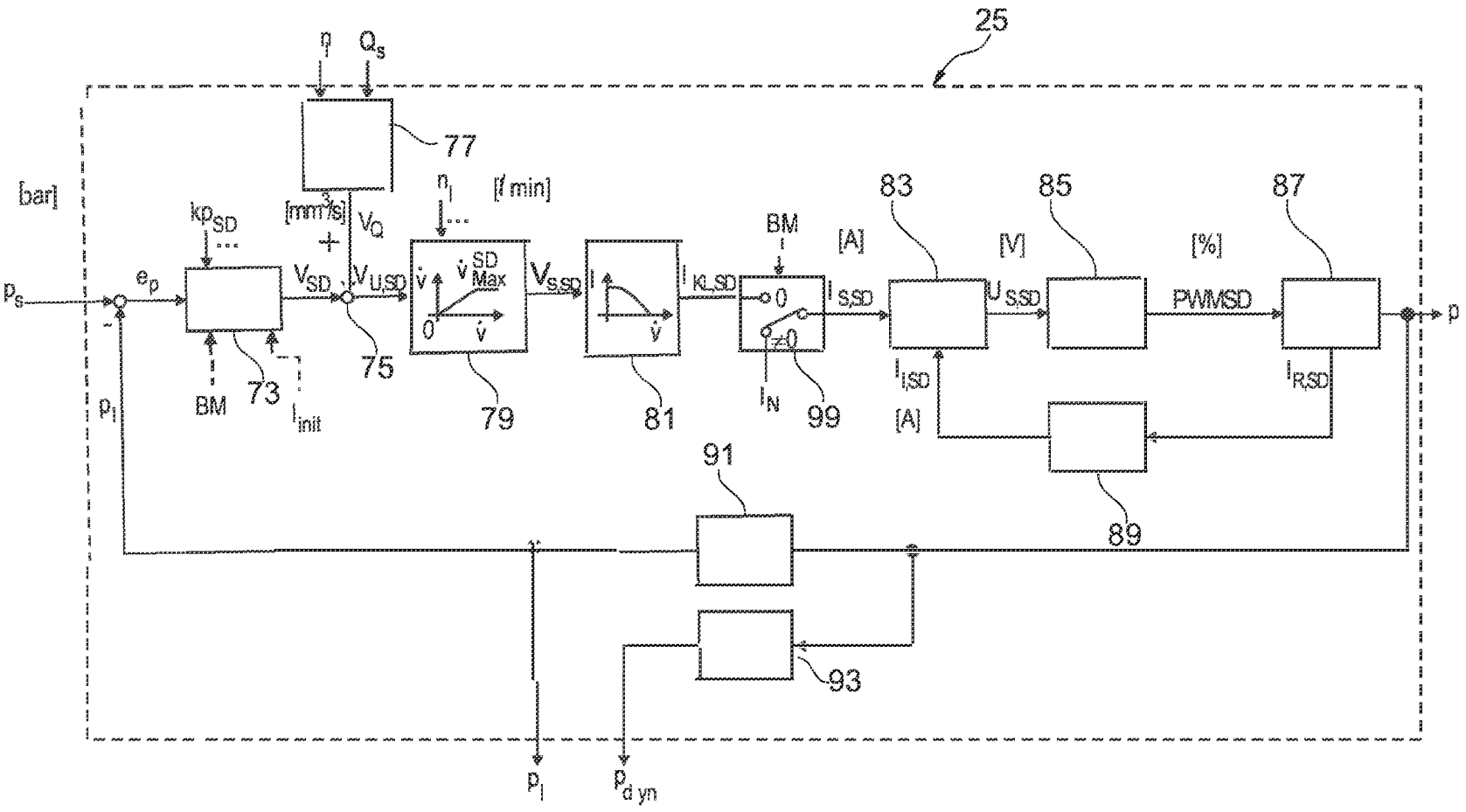
FIG. 9 is a detailed representation of a design example of a method for operating an injection system.

FIG. 9 is an additional representation of one embodiment of the method for operating injection system 3. The illustration according to FIG. 9 is herein based on the illustration according to FIG. 5*b*) and relates to actuation of suction throttle 9 which—with the exception of the later discussed modifications—is consistent with the approach discussed in connection with FIG. 5*b*) to which reference is made herein. As discussed in further detail below in connection with FIG. 10, high pressure regulator 73, according to the herein disclosed technical teachings receives on the one hand as an additional input variable the value of variable BM and on the other hand the integral initial value $I_{init}$. In addition, third switching element 71 is replaced by a second operating mode switching element 99 so that now actuation of suction throttle 9 between characteristics curve-suction throttle current $I_{KL,SD}$ and suction throttle emergency power IN is no longer switched over, dependent on third logic signal SIG3, but rather dependent on the value of variable BM. Suction throttle 9 is controlled with characteristics curve-suction throttle current $I_{KL,SD}$ when variable BM indicates value 0, consequently when normal operation is set, wherein it is actuated with emergency power IN if the value of variable BM is other than 0, in particular therefore equal to 1 or equal to 2, therefore when either the first operating mode of safety operation or the second operating mode of safety operation is set.

Figure 10:
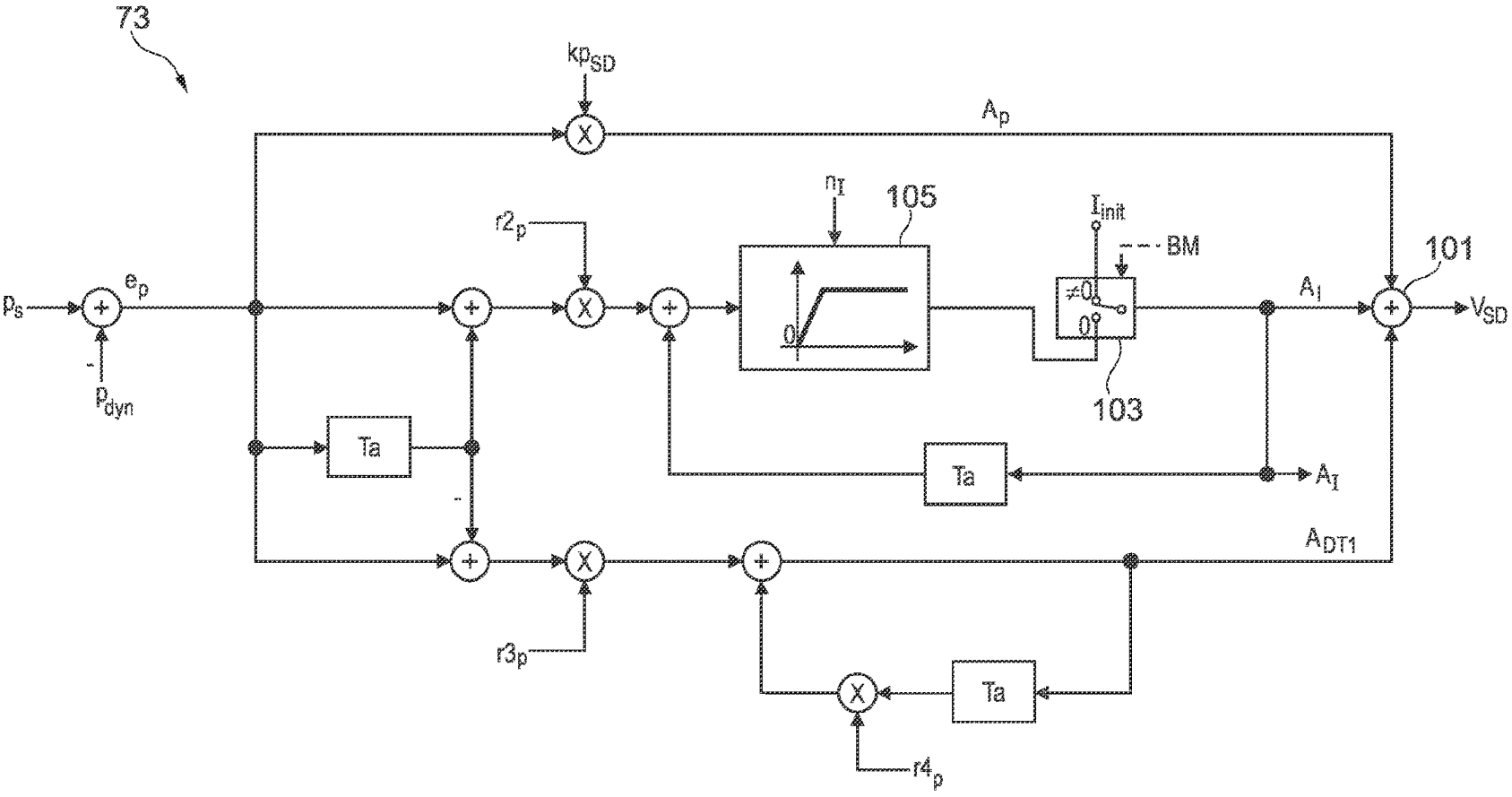
FIG. 10 is a detailed representation of a design example of a method for operating an injection system.

FIG. 10 is a schematic illustration of high pressure regulator 73 which herein is designed as a PI($DT_1$) pressure regulator. It is shown that the output value $V_{SD}$ of high pressure regulator 73 consists of three added regulator components, specifically proportional part $A_P$, integral part $A_I$, and a differential part $A_{DTT}$. At a summation point 101, these three parts are added together to output variable $V_{SD}$. Proportional part $A_P$ represents herein the product of control deviation $e_p$ with proportional coefficient $k_{PSD}$. Integral part $A_I$ is dependent on a switching position of a third operating mode switching element 103 and thus on the value of variable BM. If this is equal to zero—in other words injection system 3 in normal operation—integral part $A_I$ results from the sum of two summands. The first summand is herein the current integral part $A_I$, delayed by one scanning step $T_a$. The second summand is the product of an amplification factor $r2_p$ and of the sum of a control deviation $e_p$, that is current and delayed by one scanning step. The sum of both summands is thereby limited upward in a third limiting element 105 in dependence on the current speed $n_I$ and possibly other variables. Amplification factor $r2_p$ is calculated according to the following formula, in which $tn_p$ represents a reset time:

$$r2_p = \frac{64kp_{SD}T_a}{tn_p}$$

If the value of variable BM is unequal to 0, integral part $A_I$ is set equal to integral initial value $I_{init}$. Consequently this means that third operating mode switching element 103 switches over to integral initial value $I_{init}$, when changing over from normal operation in particular into the first operating mode of the safety operation occurs. Since suction throttle 9 is not actuated in this case—compare FIG. 9—there are no consequences initially. If however, changeover back into normal operation occurs, the first value used for integral part $A_I$ is the integral initial value $I_{init}$, before—due to switchover of third operating mode switching element 103—new, other values can be generated for integral part $A_I$. Consequently, as a result integral part $A_I$ is initialized with integral initial value $I_{init}$ when switching over out of first operating mode of the safety operation into normal operation.

In FIG. 10 it is also shown that integral part $A_I$ is branched off, in particular to be able to store it in an operation point dependent manner in leakage characteristics diagram 95, so this can be updated.

The calculation of differential part $A_{DT1}$ is shown in the lower section of FIG. 10. This part results as a sum of two products. The first product results from a multiplication of factor $r4_p$ with differential part $A_{DTT}$, delayed by one scanning step. The second product results from the multiplication of factor $r3_p$ with the difference of control deviation $e_p$ and control deviation $e_p$ accordingly delayed by one scanning step.

Factor $r3_p$ is calculated according to the following equation in which $tv_p$ is a lead time and $t1_p$ is a delay time:

$$r3_p = \left.\frac{2kp_{SD}tv_p}{2t1_p + T_a}\right|$$

Factor $r4_p$ is calculated according to the following equation:

$$r4_p = \left.\frac{2t1_p - T_a}{2t1_p + T_a}\right|$$

It is herein shown that amplification factors $r2_p$ and $r3_p$ depend on proportional coefficient $k_{PSD}$. In addition, amplification factor $r2_p$ is dependent on reset time $tn_p$; amplification factor $r3_p$ is dependent on lead time $tv_p$ and delay time $t1_p$. Amplification factor $r4_p$ is also dependent on delay time $t1_p$.

Figure 11:
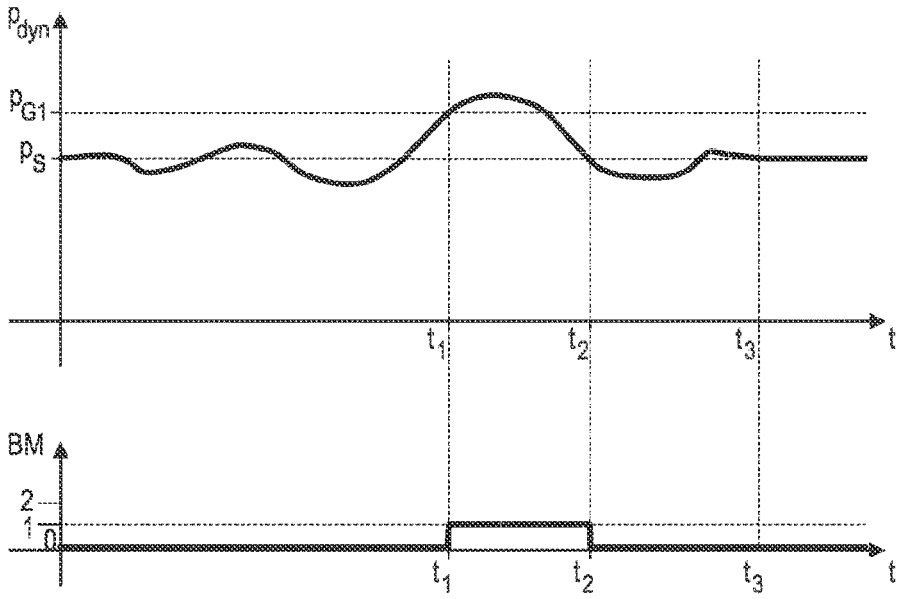
FIG. 11 is a diagrammatic representation of the functionality of one design example of a method for operating an injection system.

FIG. 11 is a schematic explanation of the herein disclosed technical teaching by wat of two time diagrams. The upper diagram illustrates dynamic rail pressure $p_{dyn}$ as depending on time t. It illustrates in particular the progression of dynamic rail pressure $p_{dyn}$ for the event that air which has accumulated in the low pressure region gets into high pressure accumulator 13 by way of high pressure pump 11. Oscillations in the high pressure are thereby formed which slowly build up, starting from the target high pressure $p_S$. At a point in time $t_1$, dynamic rail pressure $p_{dyn}$ ultimately reaches first pressure limit value $p_{G1}$, which results in that the high pressure is now regulated by way of pressure control valve 19 and no longer, as previously by way of suction throttle 9. The lower diagram shows the time progression of the value of variable BM which changes at a first point in time $t_1$ from 0 to 1, so that switching occurs from normal operation into first mode of operation of safety operation.

In this first operating mode of safety operation the high pressure is influenced through removal of fuel via pressure control valve 19 and can be regulated to target high pressure $p_S$. By removal of fuel out of high pressure accumulator 13 a drop of high pressure occurs towards target high pressure $p_S$ until the latter is ultimately reached at a point in time $t_2$ and is subsequently undershot. By reaching target high pressure $p_S$ from above, in other words from first pressure limit value $p_{G1}$, the value of variable BM is again set to 0, thus switching over to normal operation, as can be seen from the lower diagram. Therefore, the high pressure is again regulated with by way of suction throttle 9. Because together with the fuel, air is also removed from high pressure accumulator 13, a stable transient oscillation of the high pressure to its target value occurs as a consequence, wherein in the illustrated case, at a third point in time t the high pressure has returned completely to target high pressure $p_S$.

It has thus been advantageously achieved that internal combustion engine 1 in the event of high pressure oscillations which are caused by air in injection system 3 changes only briefly into the first operating mode of safety operation and subsequently, when the air has escaped from high pressure accumulator 13 due to actuation of pressure valve 19, returns to normal operation, wherein the high pressure is again regulated by suction throttle 9. This avoids unnecessary heating of the fuel and unnecessary load on pressure control valve 19, thus prolonging the long-term durability of internal combustion engine 1 and improving its efficiency.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for operating an injection system of an internal combustion engine, the method comprising the steps of:

providing that the injection system includes a high pressure accumulator;

regulating a high pressure in the high pressure accumulator in a normal operation by way actuating a low pressure-side suction throttle;

regulating the high pressure in the high pressure accumulator in a first operating mode of safety operation by way of actuating at least one high pressure-side pressure control valve;

carrying out a switchover from the normal operation into the first operating mode of safety operation if the high pressure in the high pressure accumulator one of reaches and exceeds a first limit pressure value; and carrying out a switchover from the first operating mode of safety operation into the normal operation if, starting from above a setpoint pressure value, the high pressure in the high pressure accumulator one of reaches and undershoots the setpoint pressure value, the setpoint pressure value being lower than the first limit pressure value.

2. The method according to claim 1, wherein an integral part for a high pressure regulator is initialized with an integral initial value for actuation of the suction throttle when switching over from the first operating mode of safety operation into the normal operation, wherein the integral initial value is determined as a leakage value of the injection system as a function of a current operating point of the internal combustion engine.

3. The method according to claim 2, wherein the integral initial value is determined by reading out a leakage characteristics value from a leakage characteristics diagram as a function of the current operating point, wherein one of (a) the leakage value is used as the leakage characteristics value, and (b) the leakage value is calculated with at least one control factor in order to obtain the leakage characteristics value.

4. The method according to claim 3, wherein the leakage characteristics diagram is one of (a) used as a constant characteristics diagram, and (b) updated during an operation of the injection system.

5. The method according to claim 3, wherein the leakage characteristics diagram is updated during an operation of the injection system with a plurality of current values of the integral part of the high pressure regulator as a plurality of the leakage value.

6. The method according to claim 1, wherein, before switching from the first operating mode of safety operation into the normal operation, whether the suction throttle is defective is verified, wherein switching into the normal operation occurs only if the suction throttle is not defective.

7. The method according to claim 1, wherein switching into a second operating mode of safety operation occurs when the high pressure in the high pressure accumulator exceeds a second limit pressure value, wherein in the second operating mode of safety operation the at least one pressure control valve and the suction throttle are continuously open.

8. The method according to claim 1, wherein switching back into the normal operation occurs only from the first operating mode of safety operation.

9. An injection system for an internal combustion engine, the injection system comprising:

at least one injector;

a high pressure pump;

a fuel reservoir;

a high pressure accumulator, which, on the one hand, is connected fluidically with the at least one injector and, on the other hand, is connected via the high pressure pump with the fuel reservoir;

a suction throttle allocated to the high pressure accumulator as a first pressure regulating element;

at least one pressure control valve via which the high pressure accumulator is fluidically connected with the fuel reservoir; and a control unit which is operatively connected with the at least one injector, the suction throttle, and the at least one pressure control valve, the control unit being arranged to carry out a method for operating the injection system of the internal combustion engine, the method including the steps of:

providing that the injection system includes a high pressure accumulator;

regulating a high pressure in the high pressure accumulator in a normal operation by way actuating a low pressure-side suction throttle;

regulating the high pressure in the high pressure accumulator in a first operating mode of safety operation by way of actuating at least one high pressure-side pressure control valve;

carrying out a switchover from the normal operation into the first operating mode of safety operation if the high pressure in the high pressure accumulator one of reaches and exceeds a first limit pressure value; and carrying out a switchover from the first operating mode of safety operation into the normal operation if, starting from above a setpoint pressure value, the high pressure in the high pressure accumulator one of reaches and undershoots the setpoint pressure value, the setpoint pressure value being lower than the first limit pressure value.

10. The injection system according to claim 9, wherein the injection system does not include a mechanical pressure relief valve.

11. An internal combustion engine, comprising:

an injection system including:

at least one injector;

a high pressure pump;

a fuel reservoir;

a high pressure accumulator, which, on the one hand, is connected fluidically with the at least one injector and, on the other hand, is connected via the high pressure pump with the fuel reservoir;

a suction throttle allocated to the high pressure accumulator as a first pressure regulating element;

at least one pressure control valve via which the high pressure accumulator is fluidically connected with the fuel reservoir; and a control unit which is operatively connected with the at least one injector, the suction throttle, and the at least one pressure control valve, the control unit being arranged to carry out a method for operating the injection system of the internal combustion engine, the method including the steps of:

providing that the injection system includes a high pressure accumulator;

regulating a high pressure in the high pressure accumulator in a normal operation by way actuating a low pressure-side suction throttle;

regulating the high pressure in the high pressure accumulator in a first operating mode of safety operation by way of actuating at least one high pressure-side pressure control valve;

carrying out a switchover from the normal operation into the first operating mode of safety operation if the high pressure in the high pressure accumulator one of reaches and exceeds a first limit pressure value; and carrying out a switchover from the first operating mode of safety operation into the normal operation if, starting from above a setpoint pressure value, the high pressure in the high pressure accumulator one of reaches and undershoots the setpoint pressure value, the setpoint pressure value being lower than the first limit pressure value.

* * * * *